US005797261A

United States Patent [19]

Akazaki et al.

[11] Patent Number: 5,797,261

[45] Date of Patent: Aug. 25, 1998

[54] AIR-FUEL RATIO CONTROL SYSTEM FOR INTERNAL COMBUSTION ENGINES

[75] Inventors: Shusuke Akazaki; Yoichi Nishimura; Yuji Yasui, all of Wako, Japan

[73] Assignee: Honda Giken Kogyo Kabushiki Kaisha, Tokyo, Japan

[21] Appl. No.: 688,857

[22] Filed: Jul. 31, 1996

[30] Foreign Application Priority Data

Aug. 1, 1995 [JP] Japan ..... 7-214002

[51] Int. Cl.[6] ..... F01N 3/20; F02D 41/14

[52] U.S. Cl. ..... 60/276; 123/674

[58] Field of Search ..... 60/276, 285; 123/674; 701/109

[56] References Cited

U.S. PATENT DOCUMENTS

| | | | |
|---|---|---|---|
| 4,831,838 | 5/1989 | Nagai et al. | 60/276 |
| 5,193,339 | 3/1993 | Furuya | 60/276 |
| 5,251,437 | 10/1993 | Furuya | 123/674 |
| 5,255,512 | 10/1993 | Hamburg et al. | 123/674 |
| 5,335,493 | 8/1994 | Uchida et al. | 60/276 |
| 5,341,641 | 8/1994 | Nakajima et al. | 123/674 |
| 5,361,582 | 11/1994 | Uchida et al. | 60/276 |

FOREIGN PATENT DOCUMENTS 5-321724 12/1993 Japan .

6-146998 5/1994 Japan .

*Primary Examiner*—Willis R. Wolfe

*Attorney, Agent, or Firm*—Nikaido, Marmelstein, Murray & Oram LLP

[57] ABSTRACT

An air-fuel ratio control system for an internal combustion engine has a first air-fuel ratio sensor arranged in an exhaust passage at a location upstream of a catalyst and a second air-fuel ratio sensor arranged in the exhaust passage at a location downstream of the catalyst. In response to an output from the first air-fuel ratio sensor, an air-fuel ratio correction coefficient is calculated for correcting an amount of fuel supplied to the engine in a manner such that an air-fuel ratio of a mixture supplied to the engine is converged to a desired air-fuel ratio. In response to an output from the second air-fuel ratio sensor, a desired air-fuel ratio correction amount is calculated for correcting the desired air-fuel ratio. A learned value of the desired air-fuel ratio correction amount is calculated, and the desired air-fuel ratio is corrected. Calculation of the learned value of the desired air-fuel ratio correction amount is permitted depending on a ratio between a time period over which the output from the second air-fuel ratio sensor is on a richer side with respect to a predetermined reference value and a time period over which the output from the second air-fuel ratio sensor is on a leaner side with respect to the predetermined reference value.

17 Claims, 27 Drawing Sheets

NE
PBA
θTH
PA
B1
TIMF
B2
B3
B4
B9
KTOTAL
KCMDM
TOUT
1
ENG
19
CAT
20
CAT
17
LAF
18
O2
22
LPF
B10
SELV
23
LPF
B16
LPF
B17
LPF
B18
PID
B19
STR
B21
KCMD
KCMD
KLAF
KSTR
KCMD
B20
SW
B22
MIDO2 FB
KCMD
KFB
B23
KCMDM

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which employs upstream and downstream air-fuel ratio sensors arranged in the exhaust system of the engine at respective upstream and downstream locations of a catalyst arranged in the same, and controls the air-fuel ratio of a mixture supplied to the engine in a feedback manner responsive to outputs from the air-fuel ratio sensors.

2. Prior Art

Conventionally, an air-fuel ratio control system for internal combustion engines has been proposed e.g. by Japanese Laid-Open Publication (Kokai) No. 5-321724, which calculates a desired air-fuel ratio based on operating conditions of the engine to control the air-fuel ratio of a mixture supplied to the engine to the desired air-fuel ratio in a feedback manner responsive to an output from an air-fuel ratio sensor arranged in the exhaust system of the combustion engine at a location upstream of a catalytic converter arranged in the same, and at the same time calculates, for each of operating regions of the engine, a desired air-fuel ratio correction amount applied to correct the desired air-fuel ratio based on an output from an air-fuel ratio sensor arranged at a location downstream of the catalytic converter and a learned value of the desired air-fuel ratio correction amount, which is to be applied immediately after the engine has entered a specific operating region, i.e., when the operating region of the engine has changed.

However, the proposed air-fuel ratio control system calculates or updates the learned value of the desired air-fuel ratio correction amount whenever it calculates the desired air-fuel ratio correction amount, so that the learned value is updated even when it is actually unnecessary to update the same, which sometimes degrades the controllability of the air-fuel ratio on the contrary.

SUMMARY OF THE INVENTION

It is the object of the invention to provide an air-fuel ratio control system for an internal combustion engine, which is capable of preventing a learned value of a desired air-fuel ratio correction amount from being unnecessarily updated to thereby improve the controllability of the air-fuel ratio.

To attain the above object, the present invention provides an air-fuel ratio control system for an internal combustion engine having an exhaust passage, and catalyst means arranged in the exhaust passage, for purifying exhaust gases emitted from the engine, the air-fuel ratio control system including a first air-fuel ratio sensor arranged in the exhaust passage at a location upstream of the catalyst means, and a second air-fuel ratio sensor arranged in the exhaust passage at a location downstream of the catalyst means, first feedback control means responsive to an output from the first air-fuel ratio sensor, for calculating an air-fuel ratio correction coefficient for correcting an amount of fuel supplied to the engine in a manner such that an air-fuel ratio of a mixture supplied to the engine is converged to a desired air-fuel ratio, second feedback control means responsive to an output from the second air-fuel ratio sensor, for calculating a desired air-fuel ratio correction amount for correcting the desired air-fuel ratio, and learning/correcting means for calculating a learned value of the desired air-fuel ratio correction amount, and for correcting the desired air-fuel ratio.

The air-fuel ratio control system according to the invention is characterized in that the learning/correcting means comprises learned value calculation-permitting means for permitting calculation of the learned value of the desired air-fuel ratio correction amount depending on a ratio between a time period over which the output from the second air-fuel ratio sensor is on a richer side with respect to a predetermined reference value and a time period over which the output from the second air-fuel ratio sensor is on a leaner side with respect to the predetermined reference value.

Preferably, the learning/correcting means includes learned correction amount-calculating means for calculating, based on the learned value of the desired air-fuel ratio correction amount, a learned correction amount for correcting the desired air-fuel ratio.

More preferably, the learning/correcting means includes averaging coefficient-setting means for setting an averaging coefficient to be applied in calculating the learned value of the desired air-fuel ratio correction amount, for each of a plurality of operating regions of the engine, the learned correction amount-calculating means calculating the learned correction amount for the each of a plurality of operating regions of the engine.

More preferably, the learned correction amount-calculating means updates the learned correction amount whenever a predetermined time period elapses.

Further preferably, the learned correction amount-calculating means updates the learned correction amount without waiting for lapse of the predetermined time period, when the engine has changed from one of the plurality of operating regions to another of the plurality of operating regions.

Preferably, the learning/correcting means corrects the desired air-fuel ratio by the use of both the desired air-fuel ratio correction amount and the learned correction amount.

More preferably, the learning/correction means changes a control constant applied in calculating the desired air-fuel ratio correction amount, when the learned correction amount-calculating means has updated the learned correction amount.

Preferably, the learning/correcting means resets both the desired air-fuel ratio correction amount and the learned value of the desired air-fuel ratio correction amount to zero, when the learned correction amount-calculating means has updated the learned correction amount.

Preferably, the first air-fuel ratio sensor has an output characteristic that the output from the first air-fuel ratio sensor is substantially proportional to the air-fuel ratio of the mixture supplied to the engine.

Preferably, the first feedback control means comprises a controller of a recurrence formula type.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
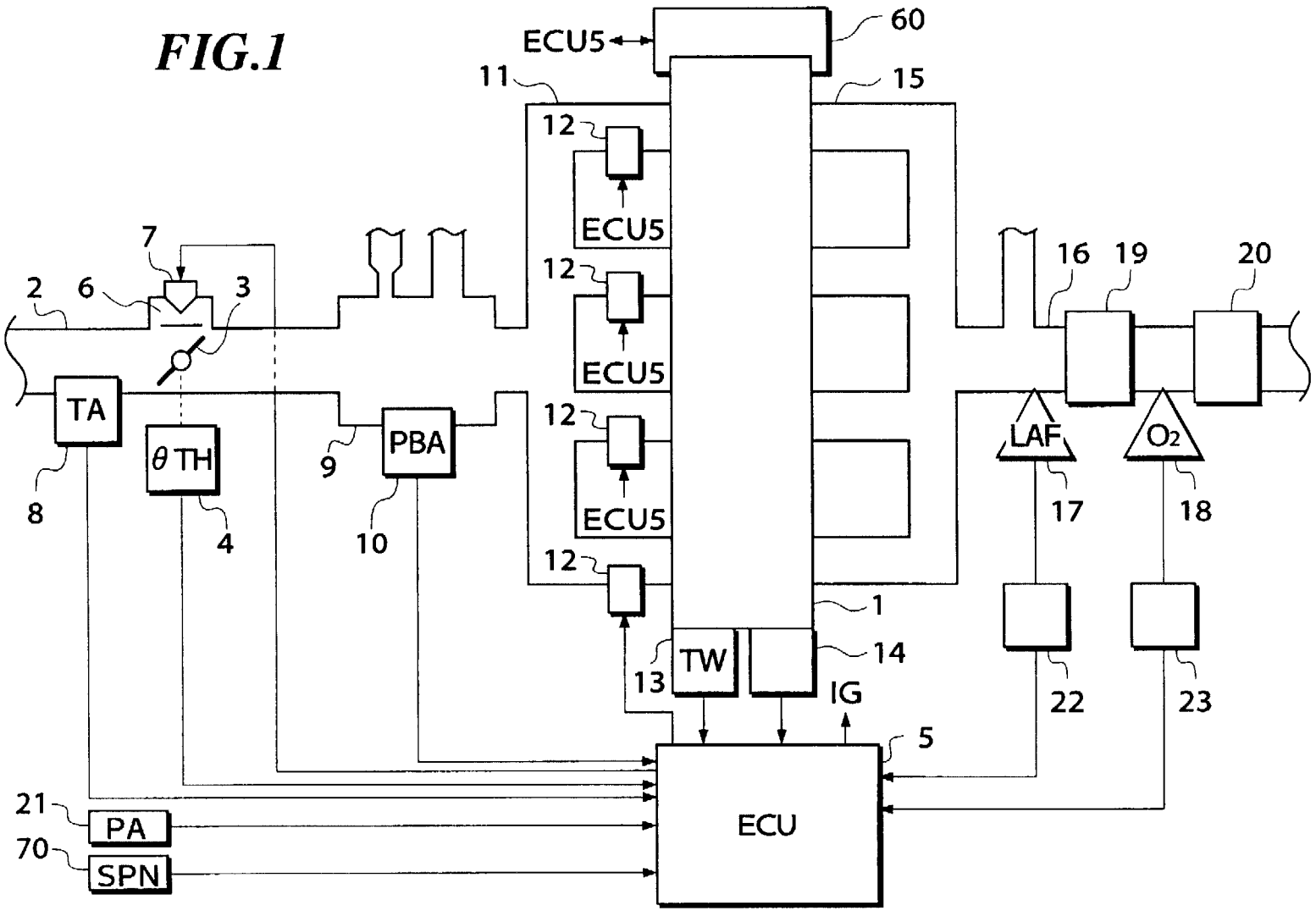
FIG. 1 is a block diagram showing the arrangement of an internal combustion engine and an air-fuel ratio control system therefor, according to a first embodiment of the invention.

Referring first to FIG. 1, there is shown the whole arrangement of an internal combustion engine (hereinafter simply referred to as "the engine"), and an air-fuel ratio control system therefor, according to a first embodiment of the invention. In the figure, reference numeral 1 designates an internal combustion engine for automotive vehicles.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3 for generating an electrical signal indicative of the sensed throttle valve opening θTH and supplying the same to an electronic control unit (hereinafter referred to as "the ECU" 5). The intake pipe 2 is provided with an auxiliary air passage 6 bypassing the throttle valve 3, and an auxiliary air amount control valve 7 is arranged in the auxiliary air passage 6. The auxiliary air amount control valve 7 is connected to the ECU 5 to have an amount of opening thereof controlled by a signal therefrom.

An intake air temperature (TA) sensor 8 is inserted into the intake pipe 2 at a location upstream of the throttle valve 3 for supplying an electronic signal indicative of the sensed intake air temperature TA to the ECU 5. The intake pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine a predetermined angle before a TDC position of the cylinder corresponding to the start of the intake stroke thereof, a TDC sensor which generates a pulse (hereinafter referred to as "the TDC signal pulse") at a predetermined crank angle position of each cylinder a predetermined angle before the TDC position of the cylinder corresponding to the start of the intake stroke thereof (whenever the crankshaft rotates through 180 degrees in the case of a four-cylinder engine), and a CRK sensor which generates a pulse (hereinafter referred to as "the CRK signal pulse") at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the air-fuel ratio control system and other control systems of the engine for determining fuel injection timing, ignition timing, etc., as well as for detecting the engine rotational speed NE.

Fuel injection valves 12 are inserted into the intake manifold 11 at locations slightly upstream of respective corresponding intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θ IG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, an immediate downstream three-way catalyst 19 and a bed-downstream three-way catalyst 20 are arranged in the confluent portion of the exhaust pipe 16 at respective locations downstream of the LAF sensor 17 for purifying noxious components, such as HC, CO, and NOx. An oxygen concentration sensor (hereinafter referred to as "the O2 sensor") 18 is arranged between the three-way catalysts 19 and 20.

The LAF sensor 17 is connected via a low-pass filter 22 to the ECU 5 for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is connected via a low-pass filter 23 to the ECU 5 for supplying the ECU 5 with the high or low level signal.

Arranged between the engine 1 and wheels, not shown, of a vehicle on which the engine 1 is installed is an automatic transmission, not shown, for transmitting torque generated by the engine 1 to the vehicle. The automatic transmission is comprised of fluid clutches, etc. By operating a shift lever, not shown, the gear shift position can be changed to a P range, an N range, or a D range.

The automatic transmission has a shift position sensor SPN 70 for detecting the gear shift position, and an electric signal indicative of the sensed shift position is supplied to the ECU 5.

The wheels of the vehicle are provided with wheel speed sensors, not shown, for detecting rotational speeds of driving wheels and trailing wheels. Electric signals indicative of the sensed rotational speeds of the wheels are supplied to the ECU 5. The ECU 5 determines, based on detected rotational speeds of the driving and trailing wheels, whether or not the driving wheels are in an excessive slip state. If the excessive slip state of the driving wheels is detected, the ECU 5 carries out traction control by making lean the air-fuel ratio of the mixture supplied to the engine or interrupting fuel supply to part of the cylinders, or by largely retarding the ignition timing.

The engine 1 has a valve timing changeover mechanism 60 which changes valve timing (inclusive of the valve lift) of at least the intake valves of the intake valves and exhaust valves between a high-speed valve timing suitable for operation of the engine in a high rotational speed region and a low-speed valve timing suitable for operation of the engine in a low rotational speed region. Further, when the low-speed valve timing is selected, one of the two intake valves is rendered inoperative, whereby stable combustion of the engine is secured even when the air-fuel ratio is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are connected to the ECU 5. A signal indicative of the sensed hydraulic pressure is supplied to the ECU 5 which in turn controls the electromagnetic valve for changing the valve timing.

Further, an atmospheric pressure (PA) sensor 21 is electrically connected to the ECU 5 for detecting atmospheric pressure PA and supplying a signal indicative of the sensed atmospheric pressure PA to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), a memory device comprised of a ROM storing various operational programs which are executed by the CPU and various maps and tables, referred to hereinafter, and a RAM for storing results of calculations from the CPU, etc., and an output circuit which delivers driving signals to the fuel injection valves 12 and other electromagnetic valves, the spark plugs, etc.

The ECU 5 operates in response to the above-mentioned signals from the sensors including the LAF sensor 17 and the O2 sensor 18 to determine various operating conditions in which the engine 1 is operating, such as an air-fuel ratio feedback control region in which the air-fuel ratio is controlled in response to outputs from the LAF sensor 17 and the O2 sensor 18, and open-loop control regions other than the air-fuel ratio feedback control region, and calculates, based upon the determined engine operating conditions, the valve opening period or fuel injection period TOUT over which the fuel injection valves 12 are to be opened, by the use of the following equation (1) in synchronism with inputting of TDC signal pulses to the ECU 5, to deliver driving signals to the fuel injection valves 12, which are based on the results of the calculation:

$$TOUT = TIMF \times KTOTAL \times KCMDM \times KFB \quad (1)$$

Figure 2:
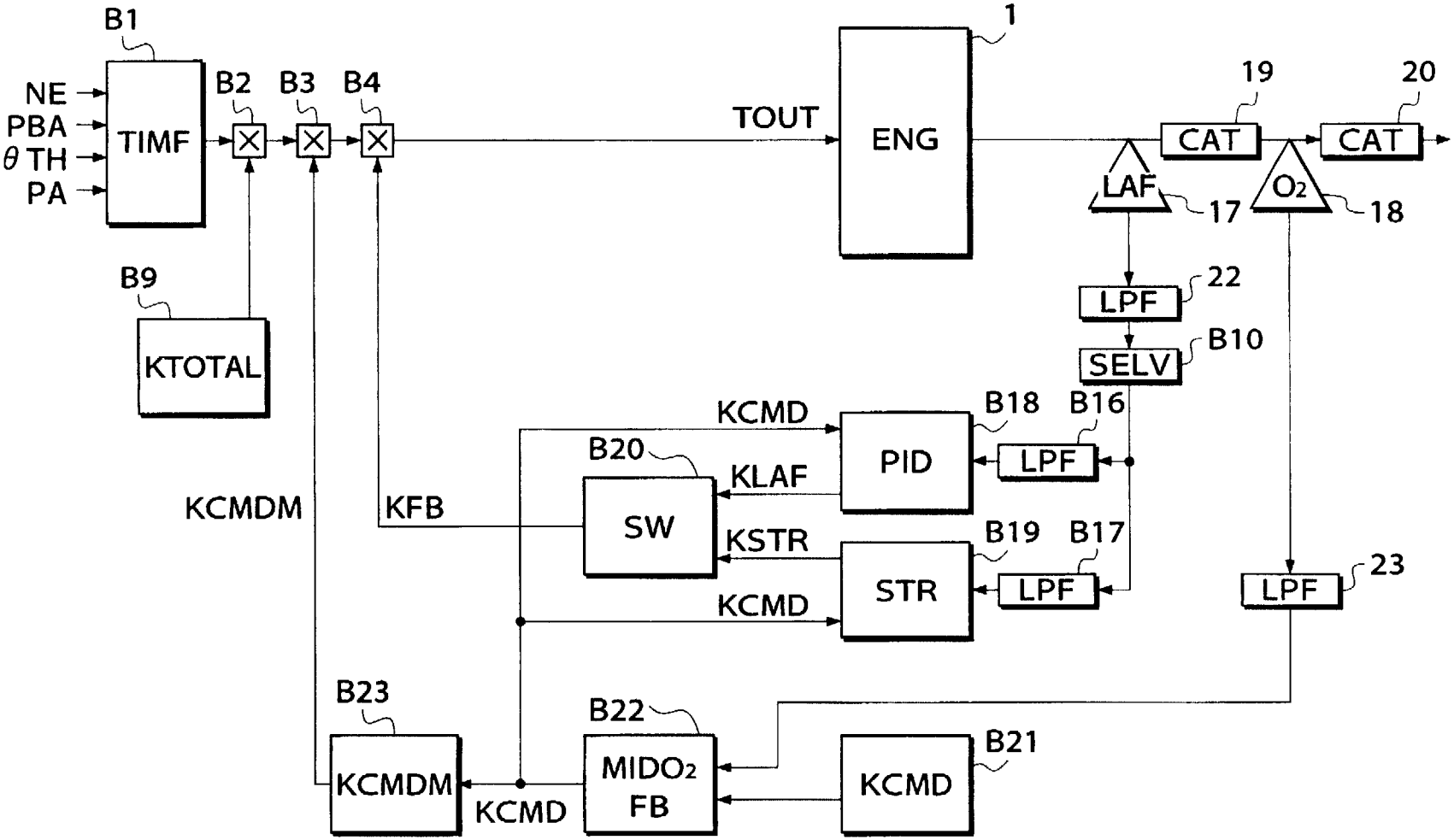
FIG. 2 is a block diagram useful in explaining functions of the air-fuel ratio control system and a manner of controlling the air-fuel ratio of a mixture supplied to the engine.

FIG. 2 shows an outline of the manner of calculating the fuel injection period TOUT according to the above equation (1), in which various blocks exhibit their functions. In the present embodiment, an amount of fuel supplied to the engine is calculated as the fuel injection period, which corresponds to an amount of fuel to be injected, and therefore the fuel supply amount TOUT will be also referred to as the fuel injection amount or the fuel amount hereinafter.

In the figure, a block B1 calculates a basic fuel amount TIMF based on the intake air amount. The basic fuel amount TIMF is basically set according to the engine rotational speed NE and the intake pipe absolute pressure PBA. Preferably, a model is prepared in advance, which represents a portion of the engine extending from the throttle valve 3 of the intake system to the combustion chamber, and a correction is made to the TIMF value in dependence on a delay of the flow of intake air obtained on the model. In this preferred method, the throttle valve opening θTH and the atmospheric pressure PA are also used as additional parameters indicative of operating conditions of the engine 1.

Reference numerals B2 to B4 designate multiplying blocks, which each multiply the basic fuel amount TIMF by parameter values input thereto, and deliver the product values. These blocks carry out the arithmetic operation of the equation (1), and an output from the multiplying block B4 provides fuel injection amounts TOUT for the respective cylinders.

A block B9 multiplies together all feedforward correction coefficients, such as an engine coolant temperature-dependent correction efficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to a block B18, a block B19 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting processing), which was sampled at the optimum timing for each cylinder, to supply the selected value to the block B18 and the block B19 via low-pass filter blocks B16 and B17. The LAF sensor output-selecting processing eliminates the inconvenience that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates a PID correction coefficient KLAF through PID control based on the difference between the actual air-fuel ratio and the desired air-fuel ratio and delivers the calculated KLAF value to the block B20. The block B19 calculates an adaptive control correction coefficient KSTR through adaptive control (Self-Tuning Regulation), based on the detected air-fuel ratio, and delivers the calculated KSTR value to the block B20. The reason for employing the adaptive control is as follows: If the basic fuel amount TIMF is merely multiplied by the desired air-fuel ratio coefficient KCMD (KCMDM), the resulting desired air-fuel ratio and hence the detected air-fuel ratio may become dull due to a response lag of the engine. The adaptive control is employed to dynamically compensate for the response lag of the engine to thereby improve the toughness of the air-fuel ratio control against external disturbances.

The block B20 selects either the PID correction coefficient KLAF or the adaptive control correction coefficient KSTR supplied thereto, depending upon operating conditions of the engine, and delivers the selected correction coefficient as a feedback correction coefficient KFB to the block B4. This selection is based on the fact that the use of the correction coefficient KLAF calculated by the ordinary PID control can be more suitable for the calculation of the TOUT value than the correction coefficient KSTR, depending on operating conditions of the engine.

According to the present embodiment, as described above, either the PID correction coefficient KLAF calculated by the ordinary PID control in response to the output from the LAF sensor 17, or the adaptive control correction coefficient KSTR calculated by the adaptive control is selectively applied as the feedback correction coefficient KFB to the equation (1) to calculate the fuel injection amount TOUT. When the correction coefficient KSTR is applied, the responsiveness of the air-fuel ratio control exhibited when the desired air-fuel ratio is changed or the actual air-fuel ratio is changed and the toughness of the air-fuel ratio control against external disturbances can be improved, and hence the purification rate of the catalysts can be improved to ensure excellent exhaust emission characteristics of the engine in various operating conditions of the engine.

In the present embodiment, the functions of the various blocks in FIG. 2 are each performed by arithmetic operations by the CPU of the ECU 5, which will be described in detail with reference to flowcharts for carrying out the operations.

Figure 3:
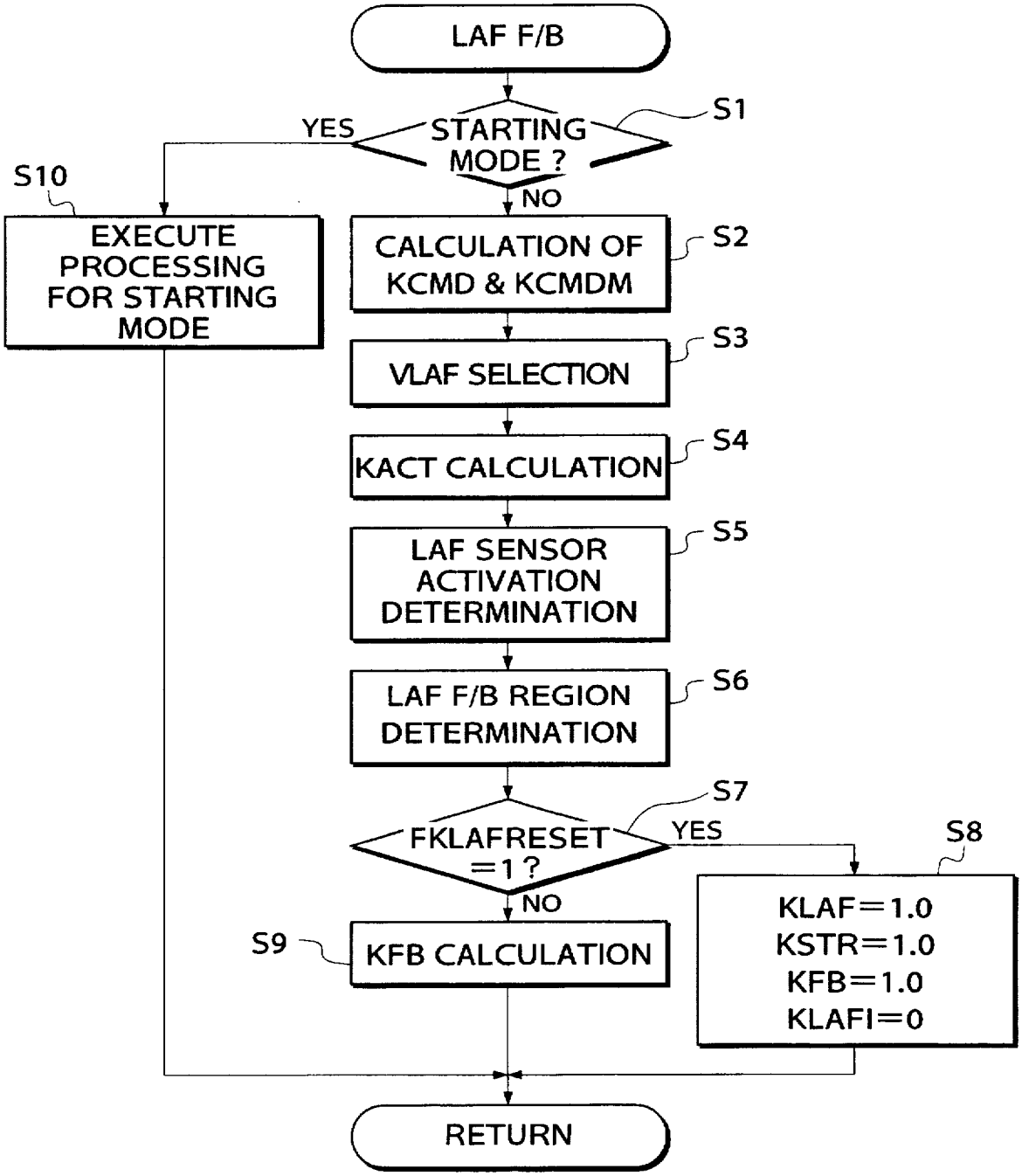
FIG. 3 is a flowchart showing a routine for calculating a feedback correction coefficient KFB, based on an output from an LAF sensor appearing in FIG. 1.

FIG. 3 shows a routine for calculating the PID correction coefficient KLAF and the adaptive control correction coefficient KSTR, according to the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S10 to execute a subroutine for the starting mode. If the engine is not in the starting mode, the desired air-fuel ratio coefficient (the desired equivalent ratio) KCMD and the final desired air-fuel ratio coefficient KCMDM are calculated at a step S2, and the LAF sensor output-selecting processing is executed at a step S3. Further, an actual equivalent ratio KACT is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined that the engine is in the LAF feedback control region, the reset flag FKLAFRESET is set to "0".

At the following step S7, it is determined whether or not the reset flag FKLAFRESET assumes "1". If FKLAFRESET=1 holds, the program proceeds to a step S8, wherein the PID correction coefficient KLAF, the adaptive control correction coefficient KSTR, and the feedback correction coefficient KFB are all set to "1.0", and an integral term KLAFI of the PID control is set to "0", followed by terminating the present program. On the other hand, if FKLAFRESET=0 holds, the feedback correction coefficient KFB is calculated at a step S9, followed by terminating the present program.

Details of operations executed at the steps S2, S4, S6, and S9 will be described hereinbelow.

Figure 4:
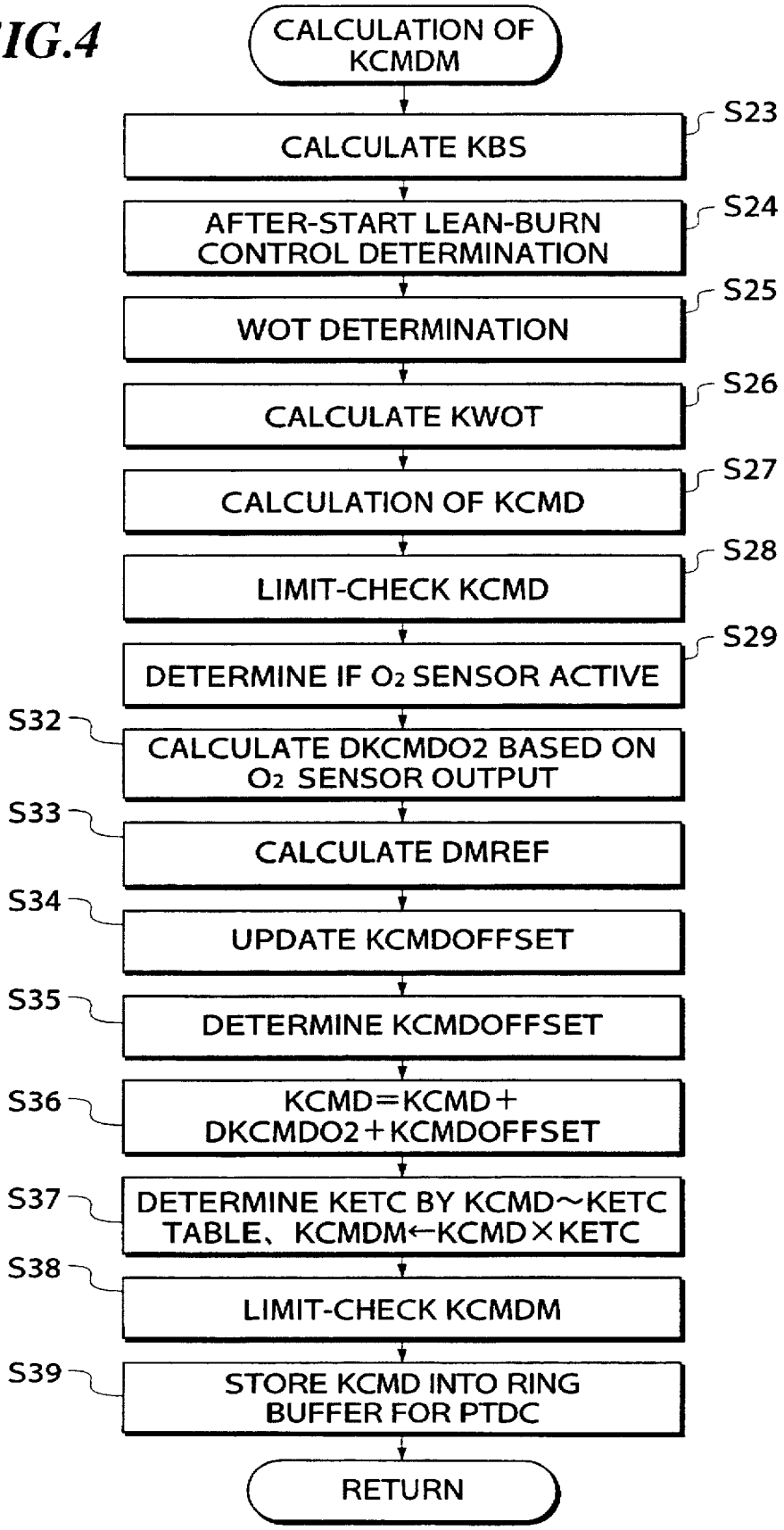
FIG. 4 is a flowchart showing a subroutine for calculating a final desired air-fuel ratio coefficient KCMDM, which is executed at a step S2 in FIG. 3.

FIG. 4 shows a subroutine for calculating the final desired air-fuel ratio correction coefficient KCMDM, which is executed at the step S2 in FIG. 3.

At a step S23, a basic value KBS is determined by retrieving a map according to the engine rotational speed NE and the intake pipe absolute pressure PBA.The map also contains values of the basic value KBS to be applied during idling of the engine.

At the following step S24, it is determined whether or not conditions for carrying out so-called after-start lean-burn control are fulfilled (after-start leaning determination). If the conditions are fulfilled, an after-start leaning flag FASTLEAN is set to "1", whereas if they are not fulfilled, the flag FASTLEAN is set to "0". The conditions for the after-start lean-burn control are determined to be fulfilled when a predetermined time period has not elapsed after the start of the engine and at the same time the engine coolant temperature TW, the engine rotational speed NE and the intake pipe absolute pressure PBA are within respective predetermined ranges. The after-start lean-burn control is carried out for the purpose of preventing an increase in emission of HC occurring when the catalysts are inactive immediately after the start of the engine, as well as reducing the fuel consumption.

Then, at a step S25, it is determined whether or not the throttle valve is fully open (i.e. the engine is in a WOT condition). If the throttle valve is fully open, a WOT flag FWOT is set to "1", whereas if the throttle valve is not fully open, the same flag is set to "0". Then, an enriching correction coefficient KWOT is calculated according to the engine coolant temperature TW at a step S26. At the same time, a correction coefficient KXWOT to be applied in a high coolant temperature condition is also calculated.

At the following step S27, the desired air-fuel ratio coefficient KCMD is calculated, and then limit-checking of the calculated KCMD value is carried out to limit the KCMD value within a range defined by predetermined upper and lower limit values at a step S28. A subroutine for executing the step S27 will be described in detail hereinafter with reference to FIG. 5.

At the following step S29, it is determined whether or not the O2 sensor 18 has been activated. If the O2 sensor 18 has been activated, an activation flag FMO2 is set to "1", whereas if the O2 sensor 18 has not been activated, the same flag is set to "0". The O2 sensor 18 is determined to have been activated e.g. when a predetermined time period has elapsed after the start of the engine. At the following step S32, a correction amount (desired air-fuel ratio correction amount) DKCMDO2 for correcting the desired air-fuel ratio coefficient KCMD is calculated according to the output VMO2 from the O2 sensor 18. More specifically, the desired air-fuel ratio correction amount DKCMDO2 is calculated by the PID control according to a difference between the O2 sensor output VMO2 and a reference value VRREFM. A subroutine for executing the step S32 will be described in detail hereinafter with reference to FIG. 6.

At a step S33, a learned value DMREF of the desired air-fuel ratio correction amount DKCMDO2 is calculated, and then, a learned correction amount KCMDOFFSET to be applied in calculating the desired air-fuel ratio coefficient KCMD at a step S36 is updated by the use of the learned value DMREF at a step S34 and a value thereof is determined or selected at a step S35, followed by the program proceeding to the step S36. Subroutines for executing the steps S33, S34 and S35 will be described in detail hereinafter with reference to FIGS. 8 to 16.

At the step S36, the desired air-fuel ratio coefficient KCMD is corrected by the use of the following equation (2):

$$KCMD=KCMD+DKCMDO2+KCMDOFFSET \quad (2)$$

This correction makes it possible to set the desired air-fuel ratio coefficient KCMD in a manner compensating for a deviation of the output from the LAF sensor from its proper value.

At the following step S37, a KCMD-KETC table is retrieved according to the calculated KCMD value to determine a correction coefficient KETC, and the final desired air-fuel ratio coefficient KCMDM is calculated by the use of the following equation (3):

$$KCMDM=KCMD\times KETC \quad (3)$$

The correction coefficient KETC compensates for the influence of variation in intake air charging efficiency due to fuel cooling effects caused by fuel injection, the degree of which increases as the KCMD value increases to increase the fuel injection amount. The correction coefficient KETC is set to a larger value as the KCMD value is larger.

Then, limit-checking of the calculated KCMDM value is carried out at a step S38, and the KCMD value obtained at the step S36 is stored in a ring buffer memory at a step S39, followed by terminating the program.

Figure 5:
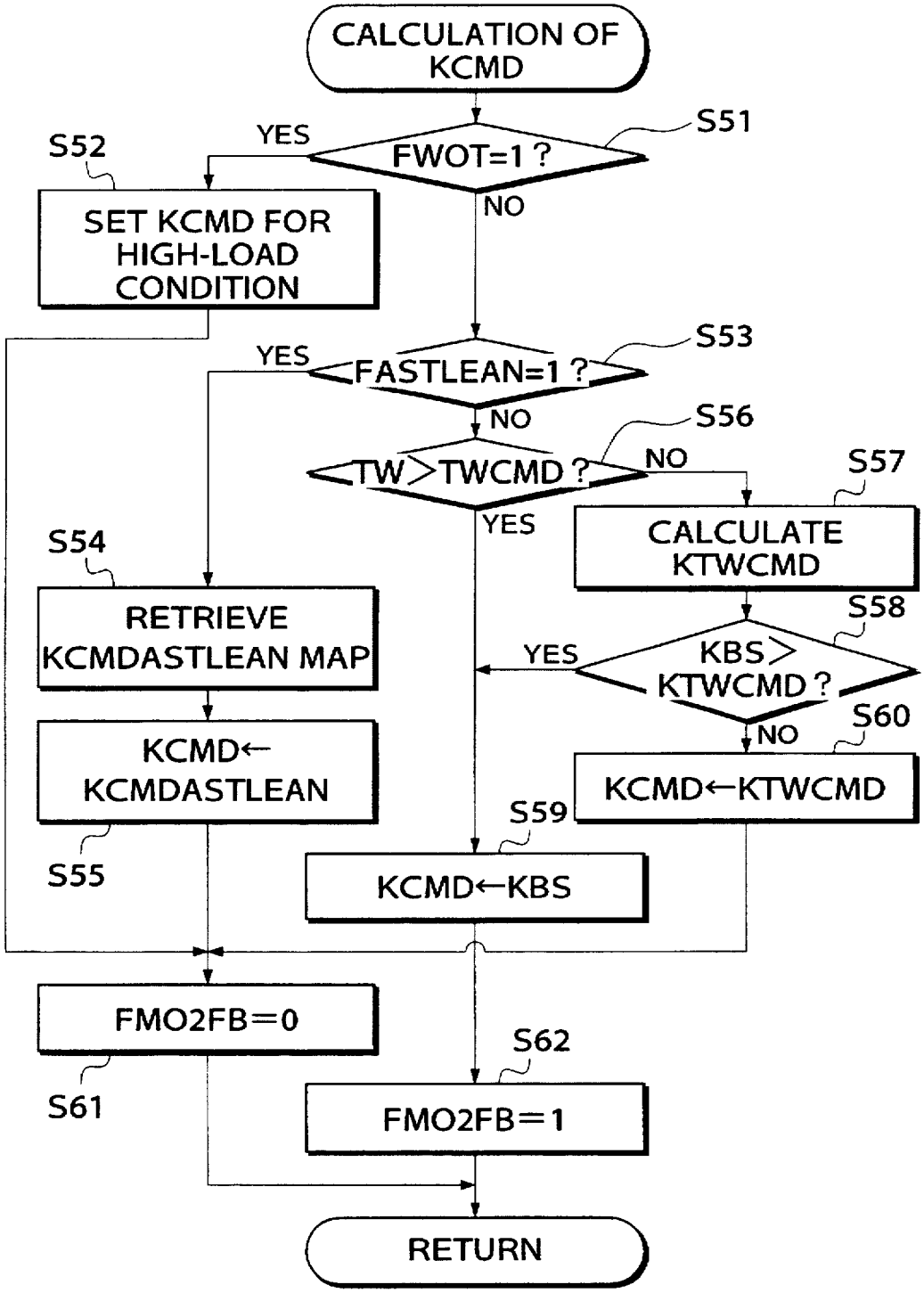
FIG. 5 is a flowchart showing a subroutine for calculating a desired air-fuel ratio coefficient KCMD, which is executed at a step S27 in FIG. 4.

FIG. 5 shows the subroutine for calculating the desired air-fuel ratio coefficient KCMD, which is executed at the step S27 in FIG. 4.

First, at a step S51, it is determined whether or not the WOT flag FWOT assumes "1". If FWOT=1 holds, which means that the engine is operating in the WOT (high-load) condition, the desired air-fuel ratio coefficient KCMD is set to a value suitable for the WOT condition of the engine at a step S52, and a feedback flag FMO2FB, which, when set to "1", indicates that the engine is in an operating condition in which the air-fuel ratio feedback control (i.e. correction of the KCMD value) responsive to the output from the O2 sensor 18 is to be carried out, is set to "0" at a step S61, followed by terminating the program.

If FWOT=0 holds at the step S51, which means that the engine is not in the WOT condition, it is determined at a step S53 whether or not the after-start leaning flag FASTLEAN which has been set at the step S24 in FIG. 4 assumes "1", and if FASTLEAN=1 holds, a KCMDASTLEAN map is retrieved to determine a leaning desired value KCMDASTLEAN which corresponds to a central air-fuel ratio suitable for the after-start lean-burn control, at a step 54. The KCMDASTLEAN map is set such that map values of the leaning desired value KCMDASTLEAN are provided in a manner corresponding to respective predetermined values of the engine coolant temperature TW and the intake pipe absolute pressure PBA. Then, at a step S55 the desired air-fuel ratio coefficient KCMD is set to the thus determined KCMDASTLEAN value, followed by the program proceeding to the step S61.

On the other hand, if FASTLEAN=0 holds at the step S53, which means that the conditions for executing the after-start lean-burn control are not fulfilled, it is determined at a step S56 whether or not the engine coolant temperature TW is higher than a predetermined value TWCMD (e.g. 80° C.). If TW>TWCMD holds, the KCMD value is set to the basic value KBS calculated at the step S23 in FIG. 4, at a step S59, and the feedback flag FMO2FB is set to "1" at a step S62, followed by terminating the program.

If TW≦TWCMD holds, a map is retrieved according to the engine coolant temperature TW and the intake pipe absolute pressure PBA to determine a desired value KTWCMD suitable for low coolant temperature at a step S57, and then it is determined at a step S58 whether or not the basic value KBS is larger than the determined KTWCMD value. If KBS>KTWCMD holds, the program proceeds to the step S59, whereas if KBS≦KTWCMD holds, the desired air-fuel coefficient KCMD is replaced by the determined desired value KTWCMD suitable for low coolant temperature at a step S60, followed by the program proceeding to the step S61.

According to this subroutine, the feedback flag FMO2FB is set to "1" only when the basic value KBS is set to the desired air-fuel coefficient KCMD without any change (when the step S59 is executed), and otherwise the same flag is set to "0".

Figure 6:
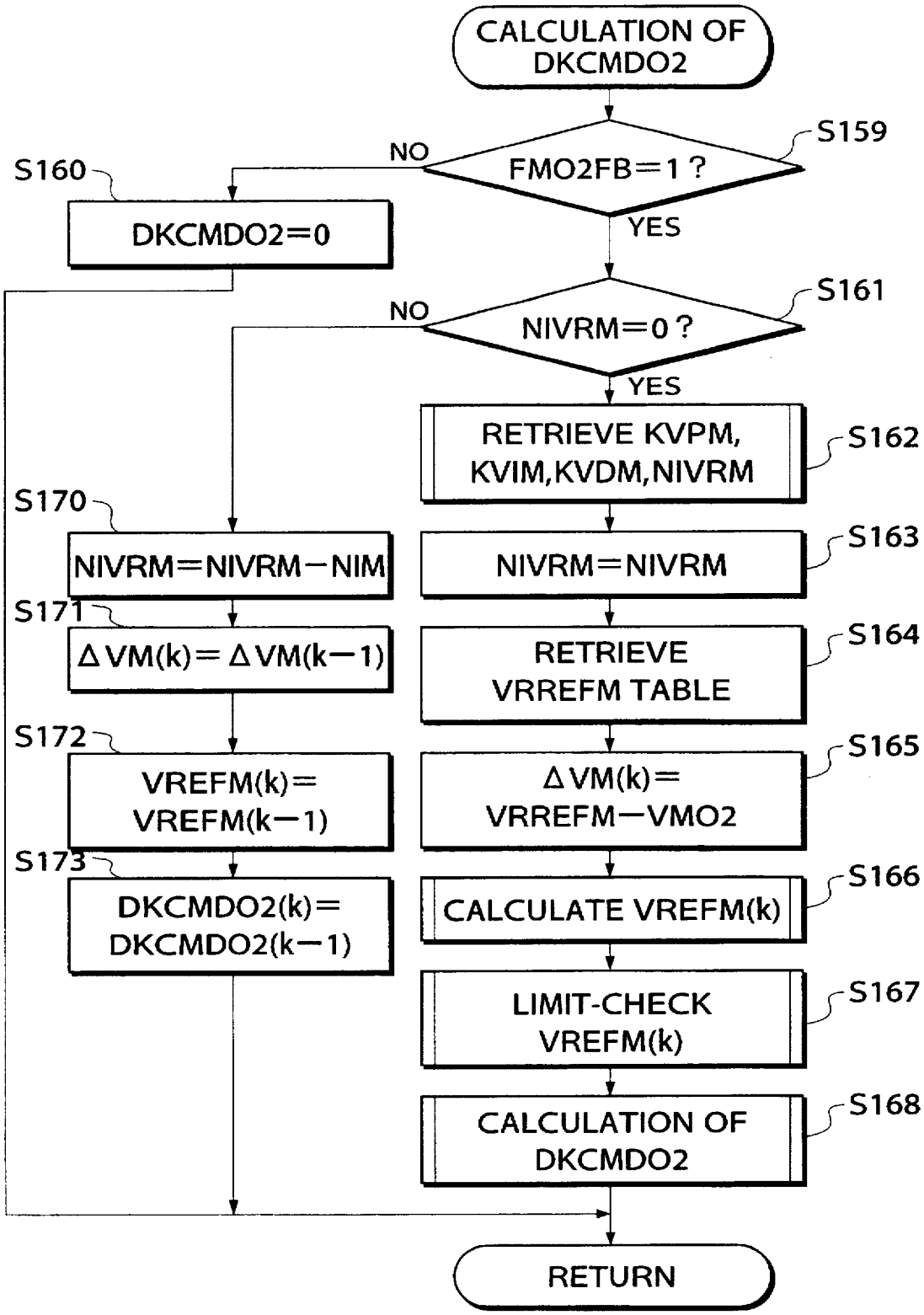
FIG. 6 is a flowchart showing a subroutine for calculating a desired air-fuel ratio correction amount DKCMDO2, which is executed at a step S32 in FIG. 4.

FIG. 6 shows the subroutine for calculating the desired air-fuel ratio correction amount DKCMDO2, which is executed at the step S32 in FIG. 4.

First, at a step S159, it is determined whether or not the feedback flag FMO2FB assumes "1". If FMO2FB=0 holds, the desired air-fuel correction amount DKCMDO2 is set to "0" at a step S160, followed by immediately terminating the program.

If FMO2FB=1 holds at the step S159, it is determined at a step S161 whether or not a thinning variable NIVRM, i.e. the count of an NIVRM counter is equal to "0". The thinning variable NIVRM is subtracted by a decremental value NIM set according to operating conditions of the engine whenever a TDC signal pulse is generated, as will be described hereinafter. When this step is first executed, the thinning variable NIVRM is equal to "0", and hence the answer to the question of the step S161 is affirmative (YES), so that the program proceeds to a step S162.

When the answer to the question of the step S161 becomes negative (NO) in any subsequent loop, the program proceeds to a step S170.

At the step S162, control gains for determining a rate of change of the control amount or the fuel injection period TOUT used in the feedback control responsive to the output from the O2 sensor 18, i.e. a proportional term (P term) coefficient KVPM, an integral term (I term) coefficient KVIM, a differential term (D term) coefficient KVDM, and the thinning variable NIVRM are calculated by retrieving a KVPM map, a KVIM map, a KVDM map and an NVRM map, respectively. These maps each contain predetermined map values set for a plurality of engine operating regions, respectively, determined according to the engine rotational speed NE and the intake pipe absolute pressure PBA. These maps are retrieved to read respective control gain values therefrom which correspond to operating conditions of the engine, and the read values are subjected to interpolation, if required.

In the present embodiment, the NIVRM map is set to "0" for almost all engine operating regions, and hence steps S162 to 168 are executed without thinning frequency of calculation of the desired air-fuel ratio correction amount DKCMDO2.

Then at a step 163, the thinning variable NIVRM is set to a NIVRM value calculated at the step 162, and then a VRREFM table is retrieved at a step S164 to determine the reference value VRREFM of the output voltage VMO2 from the O2 sensor 18. The reference voltage VRREFM is determined e.g. according to the atmospheric pressure PA, the engine coolant temperature TW, and the volume of exhaust gases (which can be determined based on the engine rotational speed and the intake pipe absolute pressure PBA). Then, at a step S165, the difference ΔVM(k) between the reference value VRREFM and the present value of the output voltage VMO2 from the O2 sensor 18 is calculated by the use of the following equation (4):

$$\Delta VM(k)=VRREFM-VMO2 \tag{4}$$

At the following step S166, desired values VREFPM(k) of the P term, VREFIM(k) of the I term, and VREFDM(k) of the D term are calculated by the use of the following equations (5A), (5B) and (5C):

$$VREFPM(k) = \Delta\ VM(k) \times KVPM \tag{5A}$$
$$VREFIM(k) = VREFIM(k-1) + \Delta\ VM(k) \times KVIM \tag{5B}$$
$$VREFDM(k) = (\Delta\ VM(k) - \Delta\ VM(k-1)) \times KVDM \tag{5C}$$

and a desired correction value VREFM(k) is calculated by adding together these correction terms by the use of the following equation (5D):

$$VREFM(k) = VREFPM(k) + VREFIM(k) + VREFDM(k) + 1.0 \tag{5D}$$

Then, at a step S167, limit-checking of the desired correction value VREFM(k) is carried out to thereby limit the desired correction value VREFM and the I term VREFIM within respective ranges each determined by predetermined upper and lower limit values thereof.

After the limit-checking of the VREFM(k) value, the program proceeds to a step S168, wherein the desired air-fuel ratio correction amount DKCMDO2 is calculated, followed by terminating the program.

Figure 7:
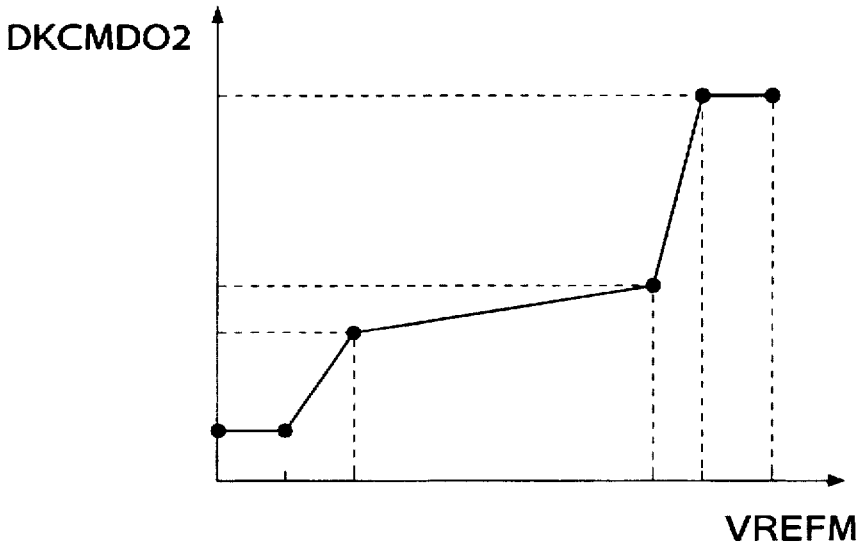
FIG. 7 shows a table for use in calculating the desired air-fuel ratio correction amount DKCMDO2.

The desired air-fuel ratio correction amount DKCMDO2 is calculated specifically by retrieving a DKCMDO2 table set e.g. as shown in FIG. 7. That is, the DKCMDO2 table is set such that the desired air-fuel ratio correction amount DKCMDO2 assumes a larger value as the desired correction value VREFM is larger. Further, since the limit-checking of the VREFM value has been carried out at the step S167, the desired air-fuel ratio correction amount DKCMDO2 is also limited by the limit-checking to a range determined by predetermined upper and lower limit values.

On the other hand, if NIVRM>0 holds at the step S161, the count of the NIVRM counter is decreased by the decremental value NIM at a step S170, and the difference Δ VM, the desired correction value VREF, and the desired air-fuel ratio correction amount DKCMDO2 are held at the immediately preceding values thereof at steps S171, S172, and S173, respectively, followed by terminating the program.

Figure 8:
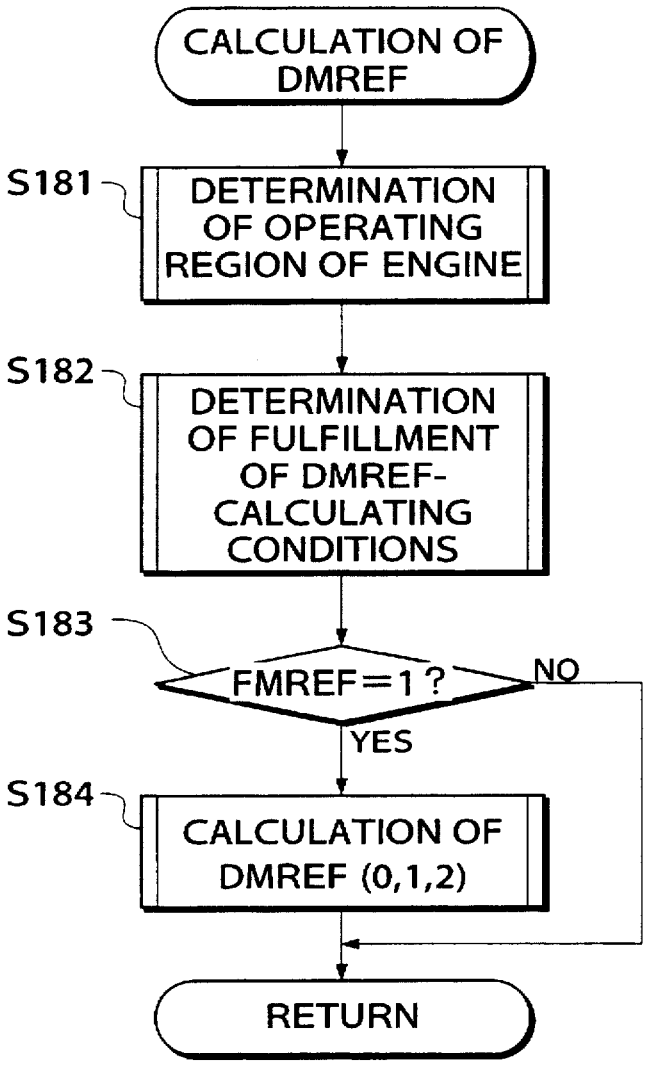
FIG. 8 is a flowchart showing a subroutine for calculating a learned value DMREF, which is executed at a step S33 in FIG. 4.

FIG. 8 shows a subroutine for calculating the learned value DMREF, which is executed at the step S33 in FIG. 4.

First, at a step S181, a region in which the engine is operating is determined, and then it is determined at a step S182 whether or not conditions for calculating the learned value DMREF are fulfilled. If the conditions are fulfilled, a learned value-calculating flag FMREF is set to "1". At the following step S183, it is determined whether or not the flag FMREF assumes "1". If FMREF=0 holds, the program is immediately terminated, whereas if FMREF=1 holds, the learned value DMREF is calculated at a step S184, followed by terminating the program.

Next, details of operations executed at the step S181, S182, and S184 will be described with reference to FIGS. 9 to 12.

Figure 9:
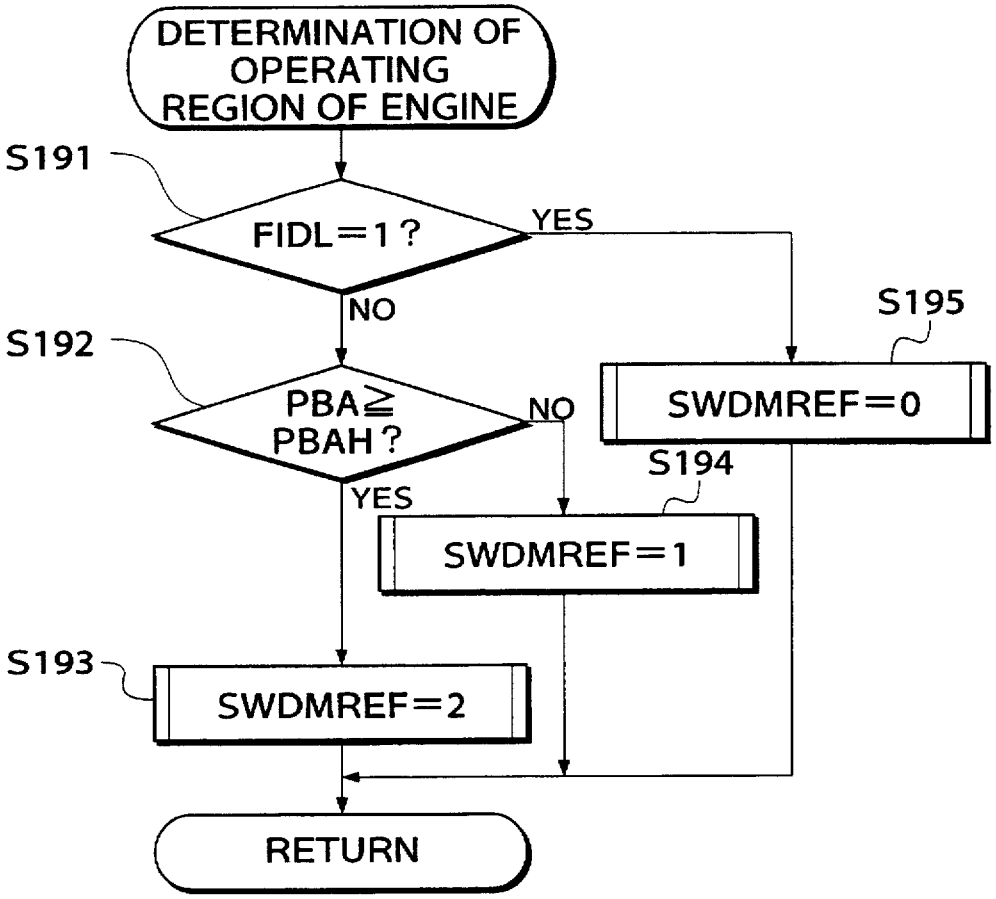
FIG. 9 is a flowchart showing a subroutine for determining operating regions in which the engine is operating to calculate the learned value DMREF for each of the operating regions, which is executed at a step S181 in FIG. 8.

FIG. 9 shows a subroutine for determining a region in which the engine is operating, which is executed at the step S181 in FIG. 8. First, at a step S191, it is determined whether or not an idling flag FIDL, which, when set to "1", indicates that the engine is idling, assumes "1". If FIDL=1 holds, a region variable SWDMREF is set to "0" at a step S195, followed by terminating the program. The idle flag FIDL is set to "1", e.g. when the throttle valve is fully closed and the engine rotational speed NE is equal to or lower than 1500 rpm.

If FIDL=0 holds, which means that the engine is not idling, it is determined at a step S192 whether or not the intake pipe absolute pressure PBA is equal to or higher than a predetermined value PBAH (e.g. 410 mmHg). If PBA<PBAH holds, it is determined that the engine is operating in a low-load region, and the region variable SWDMREF is set to "1" at a step S194, whereas if PBA≧PBAH holds, it is determined that the engine is operating in a high-load region, and the region variable SWDMREF is set to "2" at a step S193, followed by terminating the program. Since the region variable SWDMREF is set in this manner, SWDMREF=0 indicates that the engine is in an idling region, SWDMREF=1 indicates that the engine is operating in the low-load region, and SWDMREF=2 indicates that the engine is operating in the high-load region.

Figure 10:
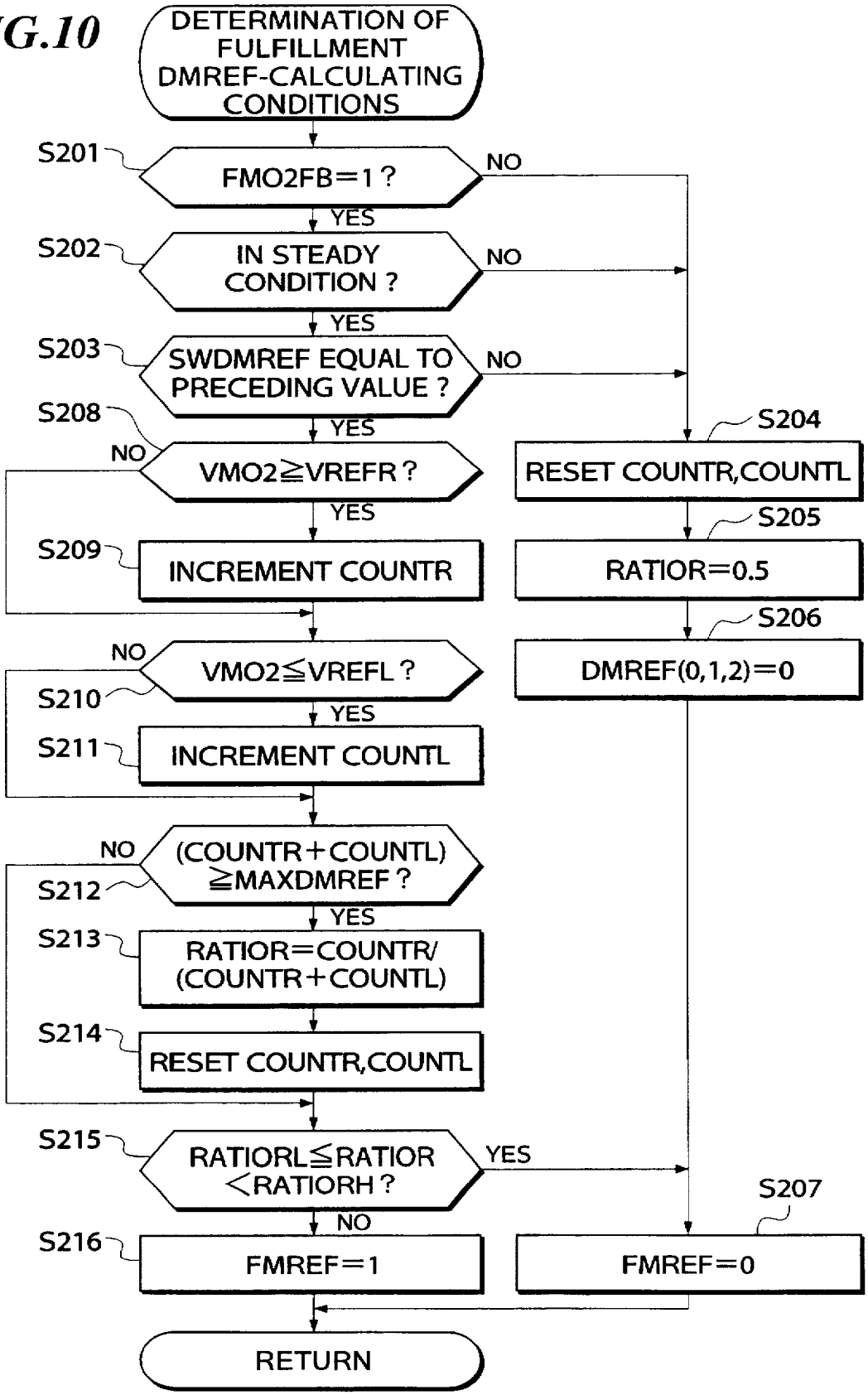
FIG. 10 is a flowchart showing a subroutine for determining whether conditions for calculating the learned value DMREF are fulfilled, which is executed at a step S182 in FIG. 8.

FIG. 10 shows a subroutine for determining whether conditions for calculating the learned value DMREF are fulfilled, which is executed at the step S182 in FIG. 8. First, at a step S201, it is determined whether or not the feedback flag FMO2FB assumes "1". If FMO2FB=1 holds, it is determined at a step S202 whether or not the engine is in a steady operating condition. This determination is carried out, e.g. by determining whether or not the difference between the present value and the immediately preceding value of the intake pipe absolute pressure PBA is within a predetermined range.

If the engine is in the steady operating condition, it is further determined at a step S203 whether or not the region variable SWDMREF is equal to the immediately preceding value thereof. If any of the answers to the questions of the steps S201 to S203 is negative (NO), i.e. if the conditions for executing the air-fuel ratio feedback control responsive to the output from the O2 sensor 18 are not fulfilled, if the engine is not in the steady operating condition, or if the region variable SWDMREF assumes a different value from the immediately preceding value thereof, which means that the engine has been shifted to a different operating region, steps S204 to S207 are executed, and it is determined that the conditions for calculating the learned value DMREF are not fulfilled. More specifically, at the step S204, the count COUNTR of a rich-side counter for cumulatively measuring or counting time periods during which the O2 sensor output VMO2 is in a predetermined rich region and the count COUNTL of a lean-side counter for cumulatively measuring or counting time periods during which the O2 sensor output VMO2 is in a predetermined lean region are both reset to "1". Then, at a step S205, a rich value relative frequency RATIOR calculated at a step S213, referred to hereinafter, is set to "0.5", and learned values DMREF0, DMREF1 and DMREF2 are all set to "0" at a step S206. At the step S207, the learned value-calculating flag FMREF is set to "0", followed by terminating the program.

The learned values DMREF0, DMREF1, and DMREF2 are values of the learned value DMREF calculated in the idling region (the region variable SWDMREF=0), the low-load region (the region variable SWDMREF=1), and the high-load region (the region variable SWDMREF=2) of the engine, respectively, for use in respective operating regions.

Figure 11:
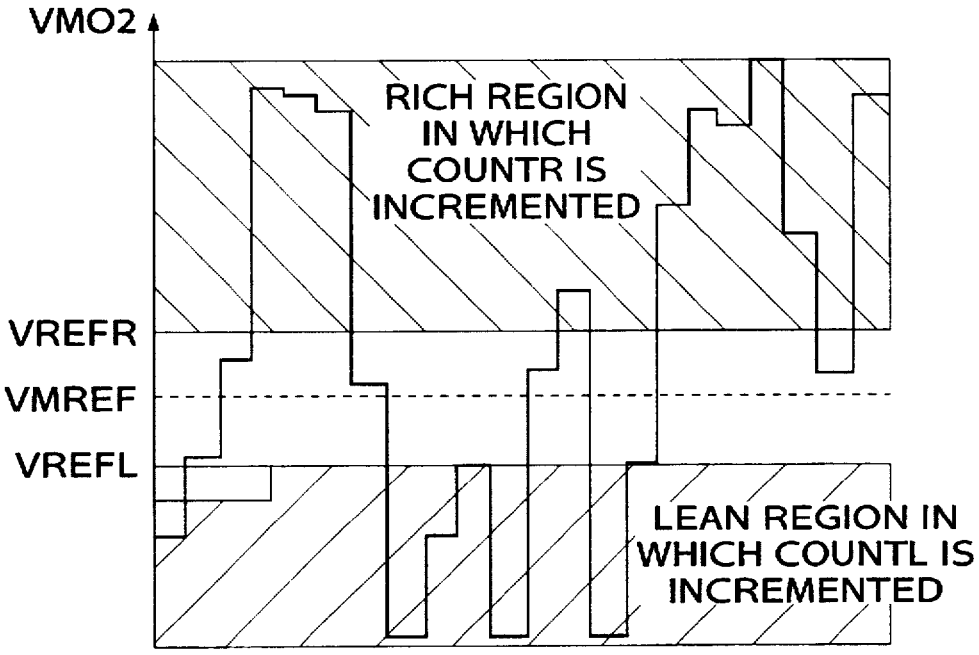
FIG. 11 shows a diagram useful in explaining the subroutine executed in FIG. 10.

If the region variable SWDMREF is equal to the immediately preceding value thereof at the step S203, it is determined at a step S208 whether or not the O2 sensor output VMO2 is equal to or higher than a predetermined rich region-determining reference value VREFR (see FIG. 11). If VMO2<VREFR holds, the program jumps to a step S210, whereas if VMO2≧VREFR holds, the program proceeds to a step S209, wherein the count COUNTR of the rich-side counter is incremented by "1", and then the program proceeds to the step S210. At the step S210, it is determined whether or not the O2 sensor output VMO2 is equal to or lower than a predetermined lean region-determining reference value VREFL (see FIG. 11). If VMO2>VREFL holds, the program jumps to a step S212, whereas if VMO2≦VREFL holds, the program proceeds to a step S211, wherein the count COUNTL of the lean-side counter is incremented by "1", and then the program proceeds to the step S212.

At the step S212, it is determined whether or not the sum of the count COUNTR of the rich-side counter and the count COUNTL of the lean-side counter (COUNTR+COUNTL) is equal to or larger than a predetermined value MAXDMREF. When this step is first executed, (COUNTR+COUNTL) <MAXDMREF holds, so that the program jumps to a step S215. At the step S215, it is determined whether or not the rich value relative frequency RATIOR is within a predetermined range defined by predetermined upper and lower limit values RATIORH (e.g. 0.7) and RATIORL (e.g. 0.4). In the present loop, RATIOR=0.5 holds (see the step S205), which means that the rich value relative frequency RATIOR is within the predetermined range, so that the program proceeds to the step S207.

If COUNTR+COUNTL≧MAXDMREF holds at the step S212 thereafter, the program proceeds to a step S213, wherein the rich value relative frequency RATIOR is calculated by the use of the following equation (6):

$$RATIOR=COUNTR/(COUNTR+COUNTL) \quad (6)$$

Then, the counts COUNTR and COUNTL of the counters are both reset to "1" at a step S214, followed by the program proceeding to the step S215. At the step S215, if RATORL≦RATIOR<RATORH holds, the program proceeds to the step S207, whereas if either RATIOR<RATIOL or RATIOR≧RATIORH holds, the learned value-calculating flag FMREF is set to "1" at a step S216, followed by terminating the program.

According to the present routine, the count COUNTR of the rich-side counter is incremented when the O2 sensor output VMO2 is in the rich region shown in FIG. 11, whereas the count COUNTL of the lean-side counter is incremented when the O2 sensor output VMO2 is in the lean region shown in the same, and the rich value relative frequency RATIOR is calculated by the use of the counts COUNTR and COUNTL. Calculation of the learned value DMREF is permitted only when the rich value relative frequency RATIOR departs from its central value (0.5) to a significant extent (RATIOR<RTIORL or RATIOR≧RTIORH), i.e. when it is estimated that the output from the LAF sensor has largely deviated from a proper value thereof. As a result, it is possible to prevent the learned value DMREF from being unnecessarily updated, and thereby improve the controllability of the air-fuel ratio control system.

Although in the present embodiment the rich value relative frequency RATIOR is used for determining fulfillment of the conditions for calculating the learned value DMREF, this is not limitative, but a lean value relative frequency RATIOL may be calculated instead to execute similar processing for the same determination.

Figure 12:
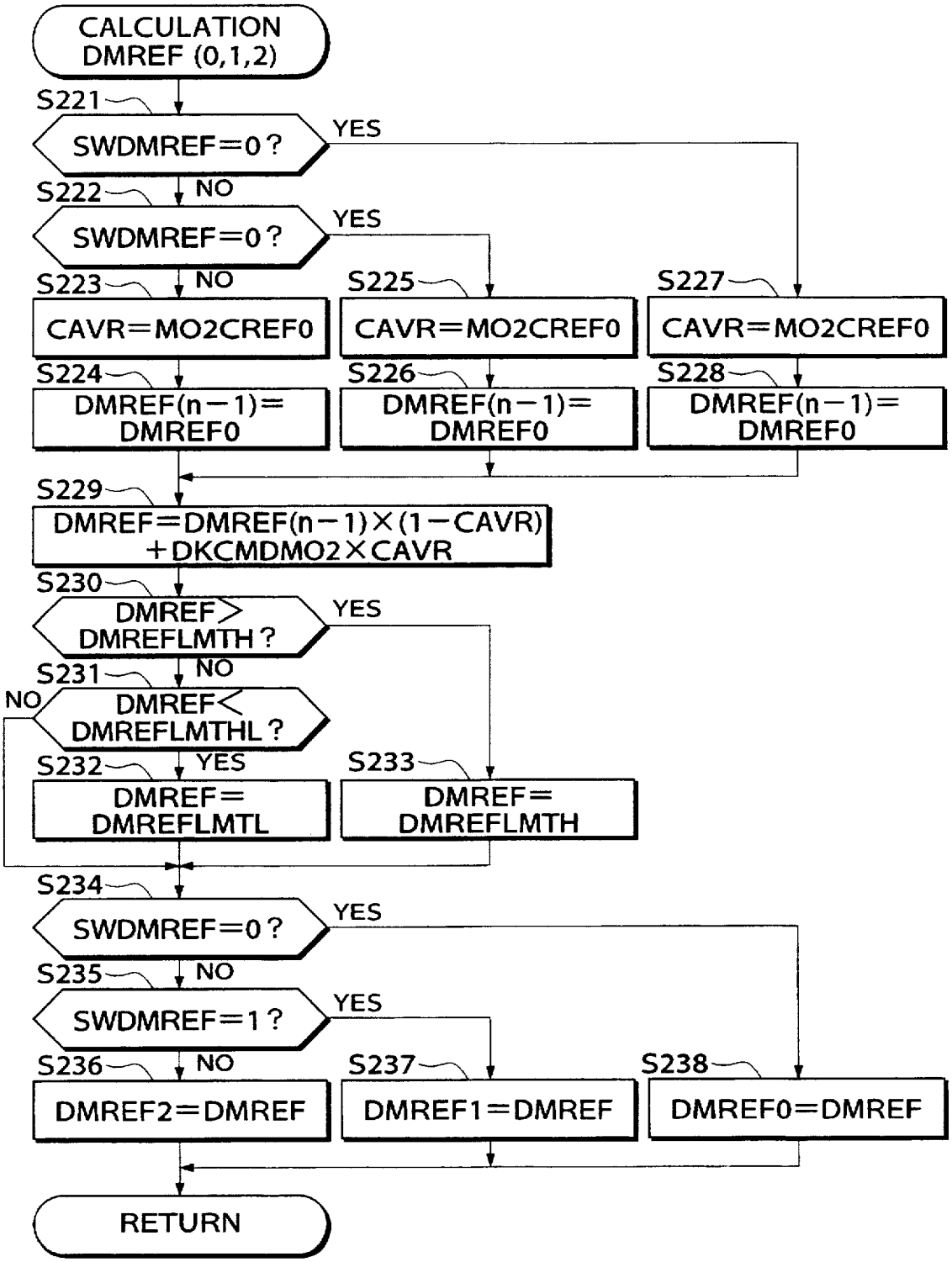
FIG. 12 is a flowchart showing a subroutine for calculating learned values DMREF0, DMREF1 and DMREF2, which is executed at a step S184 in FIG. 8.

FIG. 12 shows a subroutine for calculating the learned value DMREF, which is executed at the step S184 in FIG. 8.

First, it is determined at a step S221, whether or not the region variable SWDMREF is equal to "0" and at a step S222 whether or not the same is equal to "1". If SWDMREF=0 holds, which means that the engine is in the idling region, an averaging coefficient CREF, which is applied at a step S229, referred to hereinafter, is set to a predetermined value MO2CREF0 suitable for the idling region of the engine at a step S227, and at the following step S228 the immediately preceding learned value DMREF(n−1) is set to the learned value MDREF0 calculated on the immediately preceding occasion when the engine was in the idling region, followed by the program proceeding to the step S229. If SWDMREF=1 holds, which means that the engine is operating in the low-load region, the averaging coefficient CAVR is set to a predetermined value MO2CREF1 suitable for the low-load region of the engine at a step S225, and at the following step S226 the immediately preceding learned value DMREF(n−1) is set to the learned value MDREF1 calculated on the immediately preceding occasion when the engine was operating in the low-load region, followed by the program proceeding to the step S229. Further, if SWDMREF=2 holds (i.e. if neither SWDMREF=0 nor SWDMREF=1 holds), which means that the engine is operating in the high-load region, the averaging coefficient CAVR is set to a predetermined value MO2CREF2 suitable for the high-load region of the engine at a step S223, and at the following step S224 the immediately preceding learned value DMREF(n−1) is set to the learned value MDREF2 calculated on the immediately preceding occasion when the engine was operating in the high-load region, followed by the program proceeding to the step S229.

The predetermined values of the averaging coefficient CAVR are set to respective values between 0 and 1 which fulfill a condition of MO2CREF0<MO2CREF1<MO2CREF2.

At the step S229, the learned value DMREF is calculated by the use of the following equation (7):

$$DMREF = DMREF(n-1) \times (1 - CAVR) + DKCMDM0\ 2 \times CAVR \quad (7)$$

At the following steps S230 and S231, it is determined whether or not the learned value DMREF calculated at the step S229 is larger than an upper limit value DMREFLMTH, and smaller than a lower limit value DMREFLMTL, respectively. If DMREFLMTL≦DMREF≦DMREFLMTH holds, the program jumps to a step S234. If DMREF>DMREFLMTH holds, the learned value DMREF is set to the upper limit value DMREFLMTH at a step S233, whereas if DMREF<DMREFLMTL holds, the learned value DMREF is set to the lower limit value DMREFLMTL at a step S232, followed by the program proceeding to the step S234.

At the step S234, it is determined whether or not the region variable SWDMREF is equal to "0", and it is determined at a step S235 whether or not the same is equal to "1". If SWDMREF=0 holds, the program proceeds to a step S238, wherein the learned value DMREF0 calculated when the engine was in the idling region is updated by the learned value DMREF calculated at the step S229. If SWDMREF=1 holds, the program proceeds to a step S237, wherein the learned value DMREF1 calculated when the engine was in the low-load region is updated by the learned value DMREF. If SWDMREF=2 holds (i.e. neither SWDMREF=0 nor SWDMREF=1 holds), the program proceeds to a step S236, wherein the learned value DMREF2 calculated when the engine was in the high-load region is updated by the learned value DMREF. After executing the step S236, S237, or S238, the program is terminated.

Next, the subroutines executed at the steps S34 and S35 in FIG. 4 will be described with reference to FIGS. 13 to 16.

Figure 13:
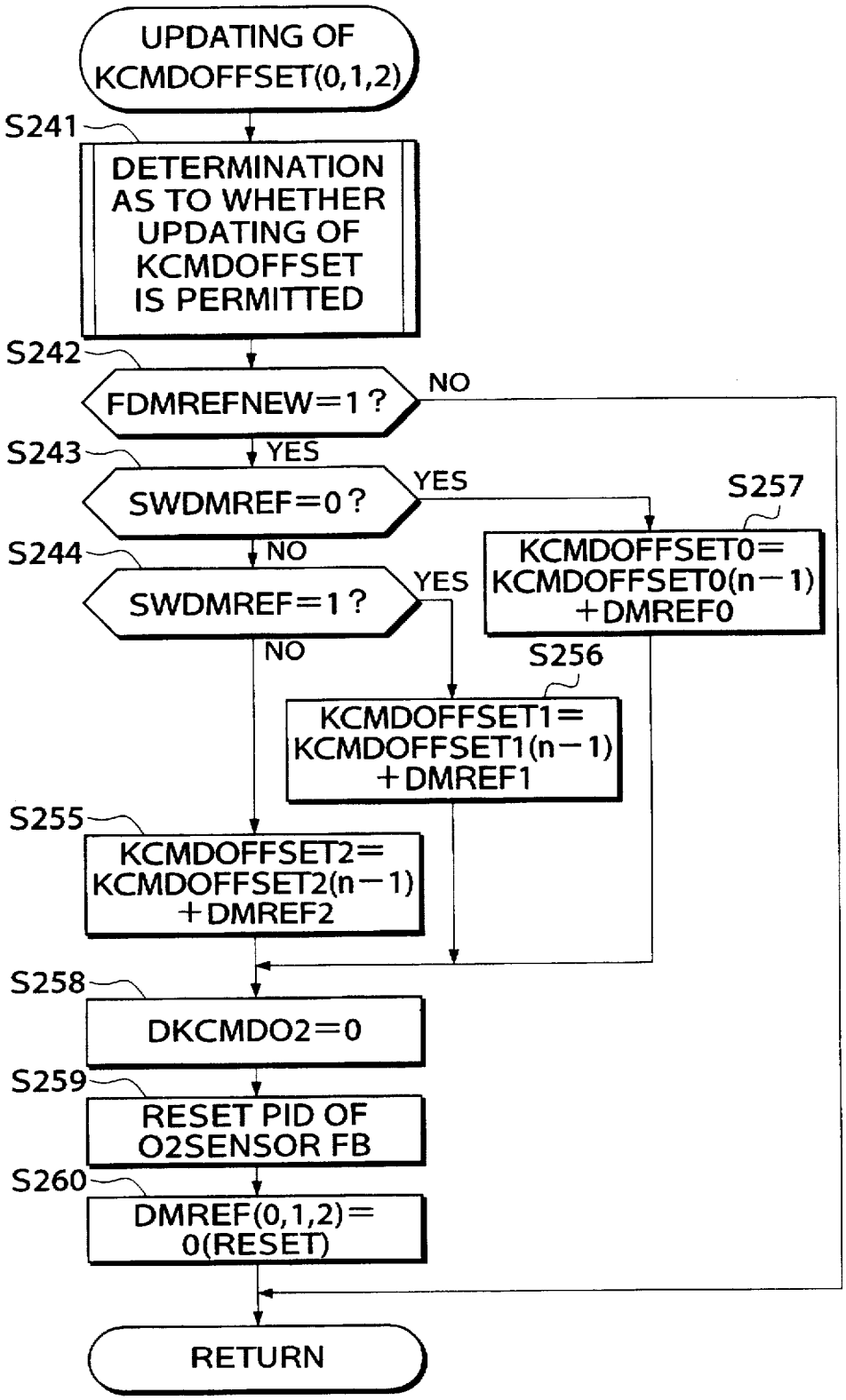
FIG. 13 is a flowchart showing a subroutine for updating a learned correction amount KCMDOFFSET, which is executed at a step S34 in FIG. 4.

FIG. 13 shows a subroutine for updating the learned correction amount KCMDOFFSET, which is executed at the step S34 in FIG. 4. First, at a step S241, it is determined whether or not updating of the learned correction amount KCMDOFFSET is permitted. This processing will be described hereinafter with reference to FIG. 14.

At the following step S242, it is determined whether or not an update-permitting flag FDMREFNEW, which, when set to "1", indicates that the updating of the learned correction amount KCMDOFFSET is permitted, assumes "1". If FDMREFNEW=0 holds, which indicates that the updating of the learned correction amount KCMDOFFSET is not permitted, the program is immediately terminated. If FDMREFNEW=1 holds, which indicates that the updating of the learned correction amount KCMDOFFSET is permitted, it is determined at a step S243 whether or not the region variable SWDMREF is equal to "0" and at a step S244 whether or not the same is equal to "1". If SWDMREF=0 holds at the step S243, the learned correction value KCMDOFFSET0 calculated when the engine was in the idling region is updated at a step S257 by adding the learned value DMREF0 calculated in the idling region to the immediately preceding value KCMDOFFSET0(n−1) of the learned correction amount KCMDOFFSET0. If SWDMREF=1 holds at the step S244, the learned correction value KCMDOFFSET1 calculated when the engine was in the low-load region is updated at a step S256 by adding the learned value DMREF1 calculated in the low-load region to the immediately preceding value KCMDOFFSET1(n−1) of the learned correction amount KCMDOFFSET1. Further, if SWDMREF=2 holds (i.e. both the answers to the questions of the steps S243 and S244 are negative (NO)), the learned correction value KCMDOFFSET2 calculated when the engine was in the high-load region is updated at a step S255 by adding the learned value DMREF2 calculated in the high-load region to the immediately preceding value KCMDOFFSET2(n−1) of the learned correction amount KCMDOFFSET2.

At the following step S258, the desired air-fuel correction amount DKCMDO2 is reset to "0", and the PID feedback control responsive to the O2 sensor output VMO2 is reset at a step S259, and further the learned values DMREF0 to DMREF2 are all reset to "0" at a step S260, followed by terminating the program. Thus, the desired air-fuel ratio correction amount DKCMDO2 is reset to "0" when the learned correction amount KCMDOFFSET is updated, whereby it is possible to prevent interference of these control amounts through addition of both of them to the desired air-fuel ratio KCMD at the step S36 in FIG. 4.

To reset the PID feedback control responsive to the O2 sensor output VMO2 specifically means that the I term VREFIM of the equation (2) is reset to "0".

Further, it may be determined whether or not the learned correction amount KCMDOFFSET value calculated by the above processing is within a predetermined range, whereby when the same value has fallen outside the predetermined range, it can be determined that the three-way catalyst 19 or the LAF sensor 17 is faulty.

Figure 14:
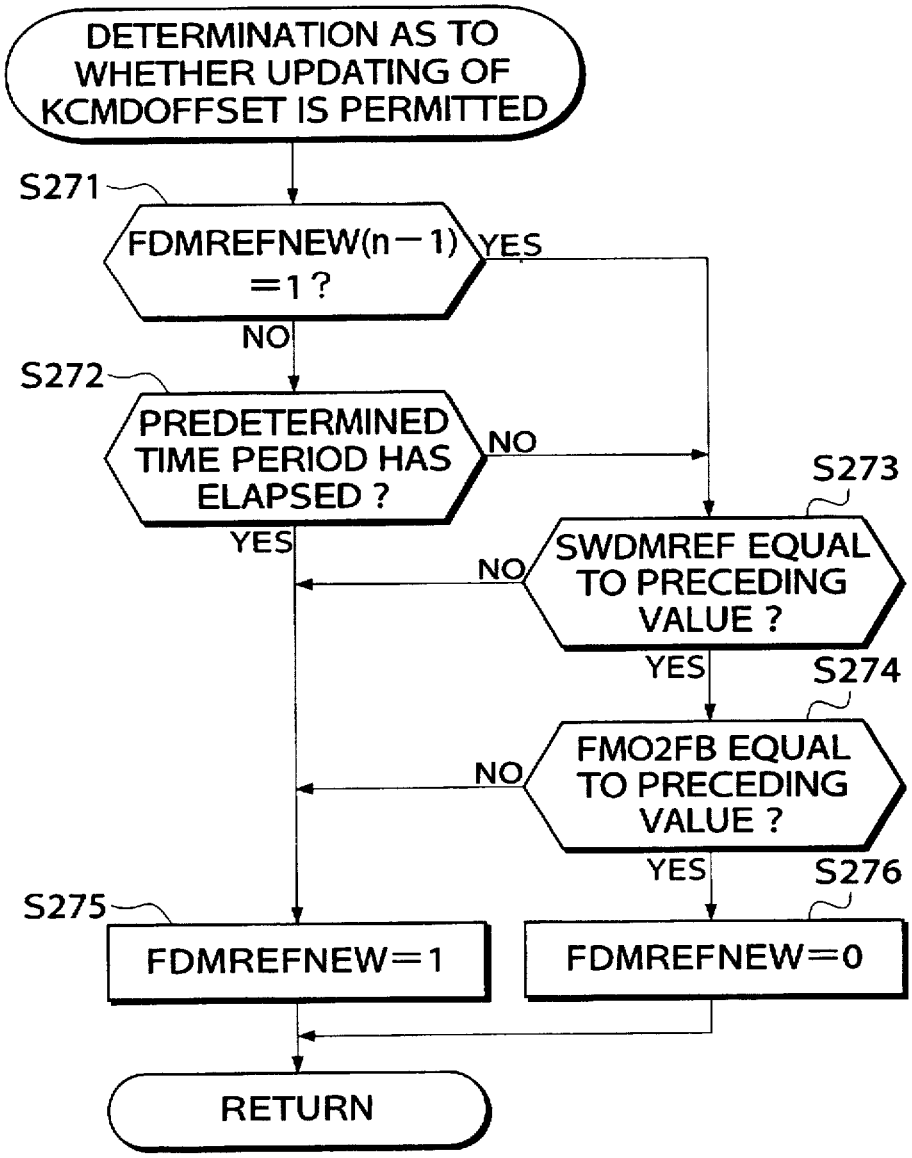
FIG. 14 is a flowchart showing a subroutine for determining whether updating of the learned correction amount KCMDOFFSET is permitted, which is executed at a step S241 in FIG. 13.

FIG. 14 shows a subroutine for determining whether the updating of the learned correction amount KCMDOFFSET is permitted, which is executed at the step S241 in FIG. 13.

First, at a step S271, it is determined whether or not the update-permitting flag FDMREFNEW assumed "1" in the immediately preceding loop, i.e. the immediately preceding value of the update-permitting flag FDMREFNEW(n−1) is equal to "1". The flag FDMREFNEW is initially set to "0", so that when the step S271 is first executed, the program proceeds to a step S272, wherein it is determined whether or not a predetermined time period TUPDATE (e.g. 5 seconds) has elapsed after the flag FDMREFNEW was set to "0". When the step S272 is first executed, the answer to the question of this step is negative (NO), and the program proceeds to a step S273, wherein it is determined whether or not the region variable SWDMREF is equal to the immediately preceding value thereof. If the region variable SWDMREF has changed, i.e. if the operating region of the engine has changed, the program proceeds to a step S275, wherein the update permitting flag FDMREFNEW is set to "1" to permit updating of the learned correction amount KCMDOFFSET, followed by terminating the program.

If it is determined at the step S273 that the region variable SWDMREF has not changed, it is further determined at a step 274 whether or not the feedback flag FMO2FB assumes the same value as in the immediately preceding loop. If the flag FMO2FB has changed, the program proceeds to the step S275, whereas if the flag FMO2FB has not changed, the program proceeds to a step S276, wherein the update-permitting flag FDMREFNEW is set to "0", followed by terminating the program.

On the other hand, if the predetermined time period TUPDATE is determined to have elapsed after the update-permitting flag FDMREFNEW was set to 0 the answer to the question of the step S271 is negative (NO) and the answer to the question of the step S272 becomes affirmative (YES)), the program also proceeds to the step S275, wherein the updating of the learned correction amount KCMDOFFSET is permitted.

As described above, according to the FIG. 14 subroutine, when the engine does not undergo a significant change in the operating condition thereof, the updating of the learned correction amount KCMDOFFSET is permitted whenever the predetermined time period TUPDATE has elapsed. Further, even before the predetermined time period has elapsed, if the region variable SWDMREF or the feedback flag FMO2FB has changed, the updating of the same is permitted.

Figure 16:
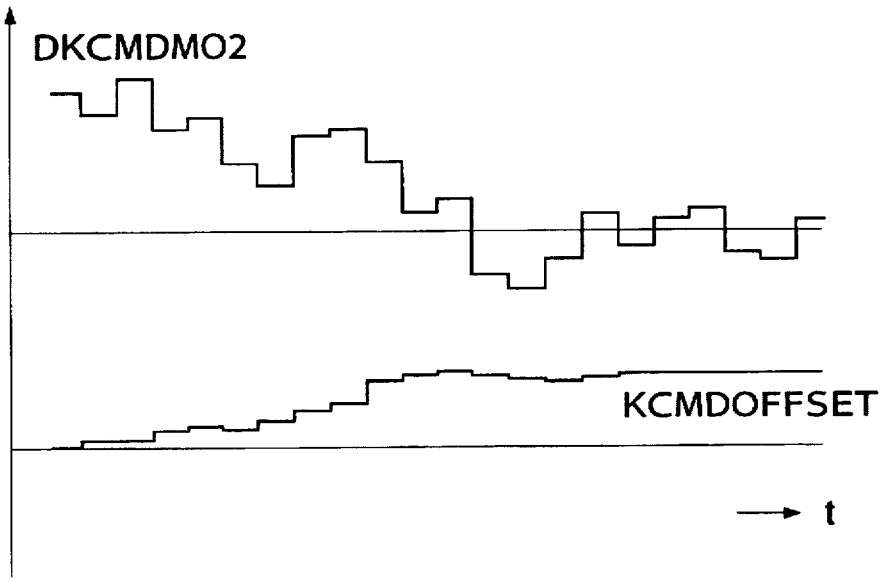
FIG. 16 shows a diagram useful in explaining the relationship between the desired air-fuel ratio correction amount DKCMDO2 and the learned correction amount KCMDOFFSET.

Since the learned correction amount KCDMOFFSET is updated by the leaned value DMREF of the desired air-fuel ratio correction amount DKCMDO2 through execution of the FIG. 13 subroutine, the desired air-fuel ratio correction amount DKCMDO2 and the learned correction amount KCMDOFFSET change, e.g. as shown in FIG. 16. That is, an increase in the desired air-fuel ratio correction amount DKCMDO2 gradually reflects on the learned correction amount KCMDOFFSET by way of the learned value DMREF, and as the DKCMDO2 value becomes closer to "0", the learned correction amount KCMDOFFSET comes to assume a value sufficient for correcting an undesired variation in the LAF sensor output.

Figure 15:
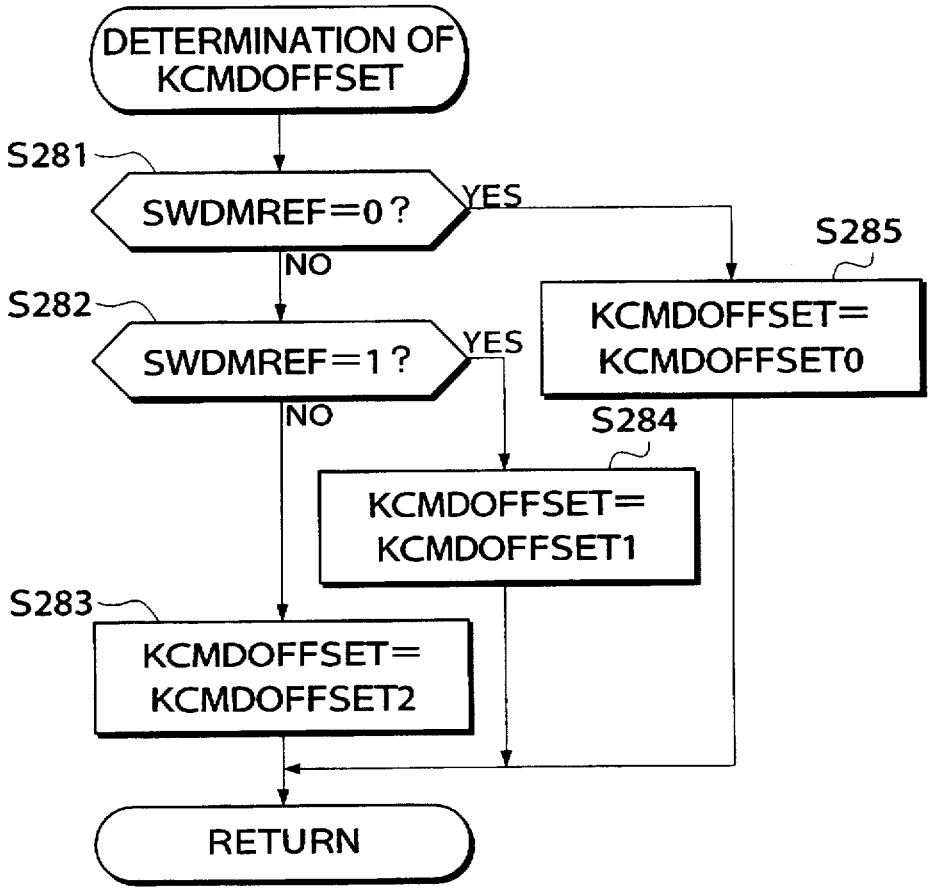
FIG. 15 is a flowchart showing a subroutine for determining the learned correction amount KCMDOFFSET, which is executed at a step S35 in FIG. 4.

FIG. 15 shows a subroutine for determining or selecting a value of the learned correction amount KCMDOFFSET, which is executed at the step S35 in FIG. 4. According to this subroutine, a KCMDOFFSET value to be applied at the step S36 in FIG. 4 is determined according to the region variable SWDMREF indicative of the present operating region of the engine.

More specifically, it is determined at a step S281 whether or not the region variable SWDMREF is equal to "0" and at a step S282 whether or not the same is equal to "1". If SWDMREF=0 holds at the step S281, the program proceeds to a step S285, wherein the learned correction amount KCMDOFFSET is set to the learned correction amount KCMDOFFSET0 calculated in the idling region of the engine. If SWDMREF=1 holds at the step S282, the program proceeds to a step S284, wherein the learned correction amount KCMDOFFSET is set to the learned correction amount KCMDOFFSET1 calculated in the low-load region. If SWDMREF=2 holds (both the answers to the questions of the steps S281 and S282 are negative (NO)), the program proceeds to a step S283, wherein the learned correction amount KCMDOFFSET is set to the learned correction amount KCMDOFFSET2 calculated in the high-load region. After executing the step S283, S284, or S285, the present program is terminated.

Figure 17:
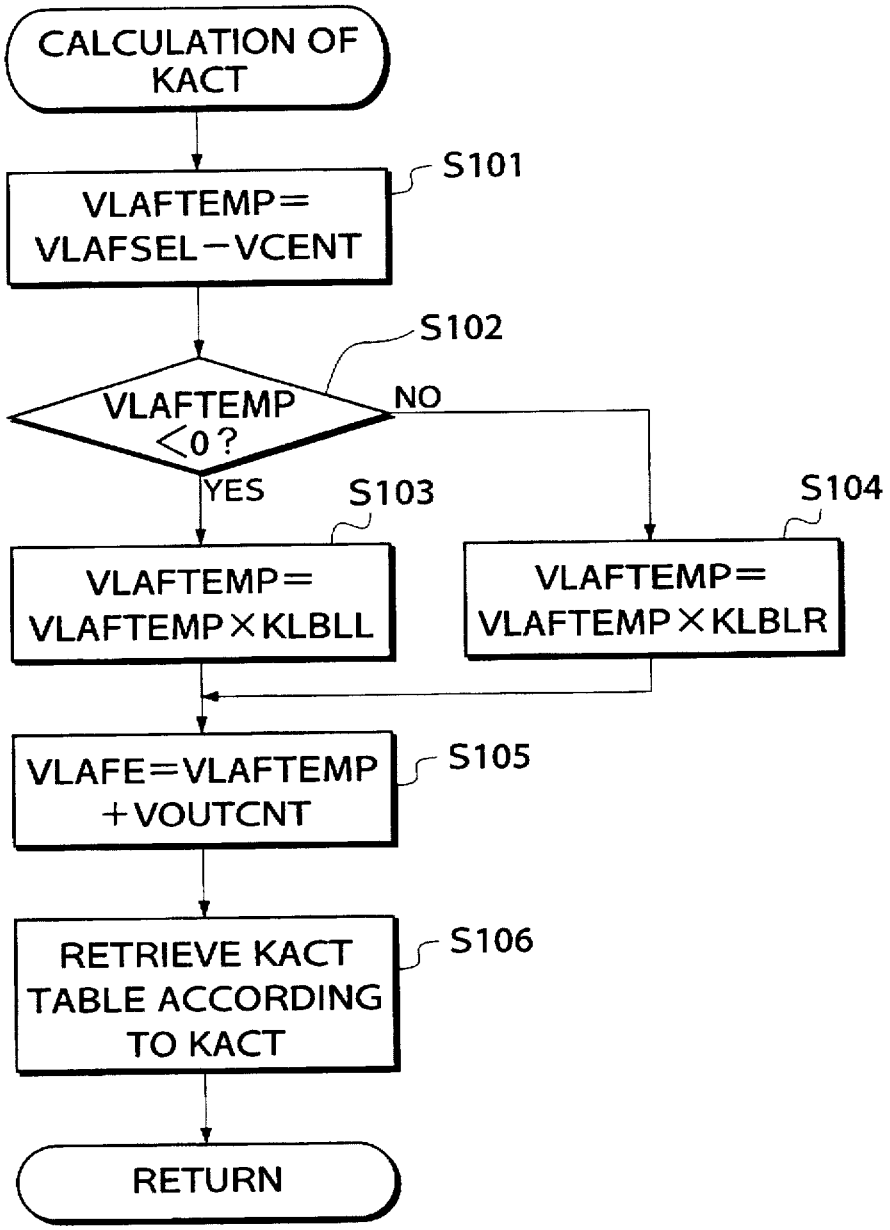
FIG. 17 is a flowchart showing a subroutine for calculating an actual equivalent ratio KACT, which is executed at a step S4 in FIG. 3.

Next, the calculation of the actual equivalent ratio KACT executed at the step S4 in FIG. 3 will be described with reference to FIG. 17.

First, at a step S101, a central value VENT of the sensor output is subtracted from the LAF sensor output value VLAFSEL to obtain a temporary value VlAFTEMP. The central value VCENT is a value of the output from the LAF sensor 17 detected when the air-fuel ratio of the mixture is equal to the stoichiometric air-fuel ratio.

Next, it is determined at a step S102 whether or not the temporary value VLAFTEMP is negative. If VLAFTEMP<0 holds, which means that the actual air-fuel ratio is leaner than the stoichiometric air-fuel ratio, the VLAFTEMP value is multiplied by a lean value correction coefficient KLBLL to correct the same at a step S103. On the other hand, if VLAFTEMP≧0 holds, which means that the actual air-fuel ratio is richer than the stoichiometric air-fuel ratio, the VLAFTEMP value is multiplied by a rich value correction coefficient KLBLR to correct the same at a step S104. The lean value correction coefficient KLBLL and the rich value correction coefficient KLBLR are calculated according to a label resistance value indicated on the LAF sensor 17 for correcting variations in sensor output value between LAF sensors to be employed. The label resistance value is set according to output characteristics of the LAF sensor measured in advance, and the ECU 5 reads the label resistance value to determine the correction coefficients KLBLL and KLBLR.

At the following step S105, a table central value VOUTCNT is added to the temporary value VLAFTEMP to calculate a corrected output value VLAFE, and a KACT table is retrieved according to the corrected output value VLAFE to determine the actual equivalent ratio KACT at a step S106. In the KACT table, the table central value VOUTCINT corresponds to lattice point data (corrected output value) corresponding to the stoichiometric air-fuel ratio (KACT=1.0).

By the above processing, the actual equivalent ratio KACT can be obtained which is free of the influence of undesired variations in output characteristics between individual LAF sensors employed.

Figure 18:
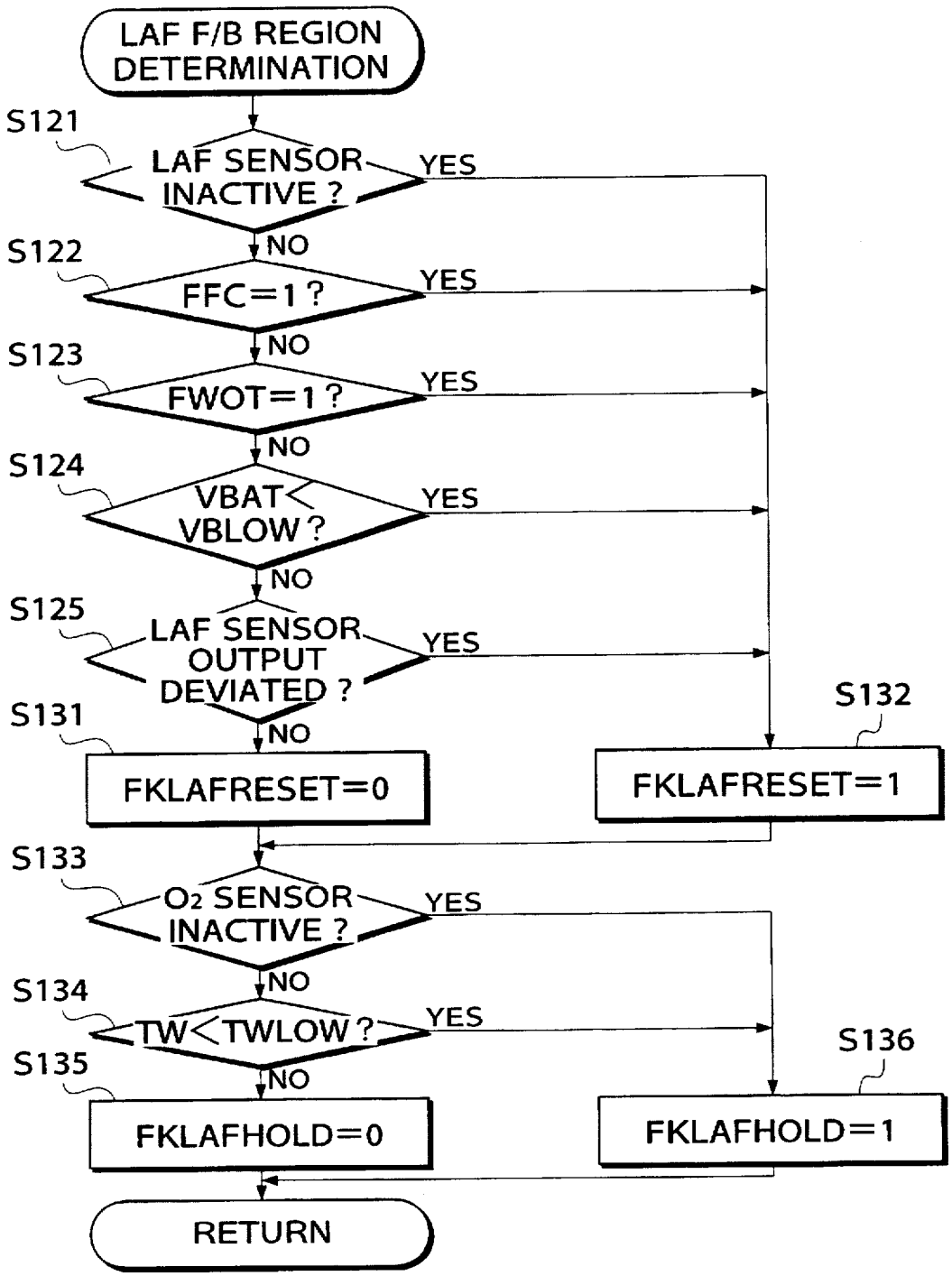
FIG. 18 is a flowchart showing a subroutine for determining whether the engine is operating in an LAF feedback control region, which is executed at a step S6 in FIG. 3.

FIG. 18 shows a LAF feedback control region-determining routine, which is executed at the step S6 in FIG. 3.

First, at a step S121, it is determined whether or not the LAF sensor 17 is inactive. If the LAF sensor 17 is inactive, it is determined at a step S122 whether or not a fuel cut flag FFC, which, when set to "1", indicates that fuel cut is being carried out, assumes "1". If FFC=0 holds, it is determined at a step S123 whether or not the WOT flag FWOT, which, when set to "1", indicates that the engine is operating in the wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from the proper value corresponding to the stoichiometric air-fuel ratio (LAF sensor output deviation). If any of the answers to the questions of the steps S121 to S125 is affirmative (YES), the aforementioned reset flag FKLAFRESET, which, when set to "1", indicates that the feedback control based on the output from the LAF sensor should be stopped, is set to "1" at a step S132.

On the other hand, if all the answers to the questions of the steps S121 to S125 are negative (NO), the KALF reset flag FKLAFRESET is set to "0" at a step S131.

At the following step S133, it is determined whether or not the O2 sensor 18 is inactive. If the O2 sensor 18 is inactive, it is determined at a step S134 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, a subroutine for calculating the feedback correction coefficient KFB, which is executed at the step S9 in FIG. 4, will be described.

The feedback correction coefficient KFB is set to the PID correction coefficient KLAF or to the adaptive control correction coefficient KSTR according to operating conditions of the engine. First, manners of calculating these correction coefficients will be described with reference to FIGS. 19 and 20.

Figure 19:
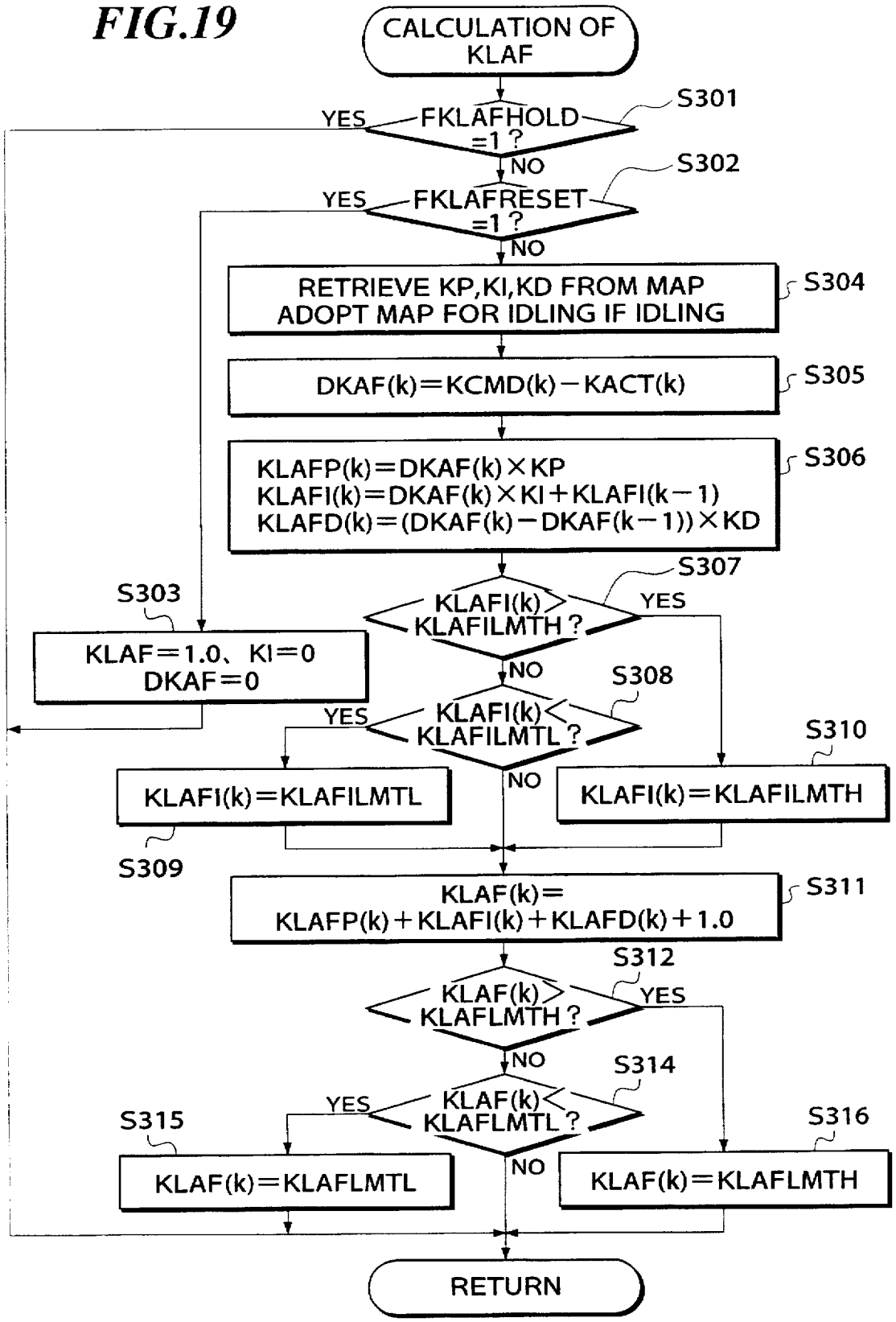
FIG. 19 is a flowchart showing a subroutine for calculating a PID correction coefficient KLAF.

FIG. 19 shows a routine for calculating the PID correction coefficient KLAF.

At a step S301 in FIG. 19, it is determined whether or not the hold flag FKLAFHOLD assumes "1". If FKLAFHOLD=1 holds, the present processing is immediately terminated, whereas if FKLAFHOLD=0 holds, it is determined at a step S302 whether or not the KLAF reset flag FKLAFRESET assumes "1". If FKLAFRESET=1 holds, the program proceeds to a step S303, wherein the PID correction coefficient KLAF is set to "1.0" and at the same time an integral term control gain KI and a difference DKAF between the desired equivalent ratio KCMD and the actual equivalent ratio KACT are set to "0", followed by terminating the program.

If FKLAFRESET=0 holds at the step S302, the program proceeds to a step S304, wherein a proportional term control gain KP, the integral term control gain KI and a differential term control gain KD are retrieved from respective maps according to the engine rotational speed NE and the intake pipe absolute pressure PBA. It should be noted that during idling of the engine, gain values for the idling condition are adopted. Then, the difference DKAF(k) (=KCMD(k)−KACT(k)) between the desired equivalent ratio KCMD and the actual equivalent ratio KACT is calculated at a step S305, and the difference DKAF(k) and the gains KP, KI, and KD are applied to the following equations (8) to (10) to calculate a proportional term KLAFP(k), an integral term KLAFI(k), and a differential term KLAFD(k) at a step S306:

$$KLAFP(k) = DKAF(k) \times KP \quad (8)$$

$$KLAFI(k) = DKAF(k) \times KI + KLAF(k-1) \quad (9)$$

$$KLAFD(k) = (DKAF(k) - DKAF(k-1)) \times KD \quad (10)$$

At the following steps S307 to S310, limit-checking of the integral term KLAFI(k) is carried out. More specifically, it is determined whether or not the KLAFI(k) value falls within a range defined by predetermined upper and lower limit values KLAFILMTH and KLAFILMTL at steps S307 and S308, respectively. If KLAFI(k)>KLAFILMTH holds, the integral term KLAFI(k) is set to the predetermined upper limit value KLAFILMTH at a step S310, whereas if KLAFI(k)<KLAFILMTL holds, the same is set to the predetermined lower limit value KLAFILMTH at a step S309.

At the following step S311, the PID correction coefficient KLAF(k) is calculated by the use of the following equation (11):

$$KLAF(k) = KLAFP(k) + KLAFI(k) + KLAFD(k) + 1.0 \quad (11)$$

Then, it is determined at a step S312 whether or not the KLAF(k) value is larger than a predetermined upper limit value KLAFLMTH. If KLAF(k)>KLAFLMTH holds, the PID correction coefficient KLAF is set to the predetermined upper limit value KLAFLMTH at a step S316, followed by terminating the program.

If KLAF(k)≦KLAFLMTH holds at the step S312, it is determined at a step S314 whether or not the KLAF(k) value is smaller than a predetermined lower limit value KLAFLMTL. If KLAF(k)≧KLAFLMTL holds, the present program is immediately terminated, whereas if KLAF(k)<KLAFLMTL holds, the PID correction coefficient KLAF is set to the predetermined lower limit value KLAFLMTL at a step S315, followed by terminating the program.

By the above subroutine, the PID correction coefficient KLAF is calculated by the PID control such that the actual equivalent ratio KACT becomes equal to the desired equivalent ratio KCMD.

Next, description will be made of calculation of the adaptive control correction coefficient KSTR with reference to FIG. 20.

Figure 20:
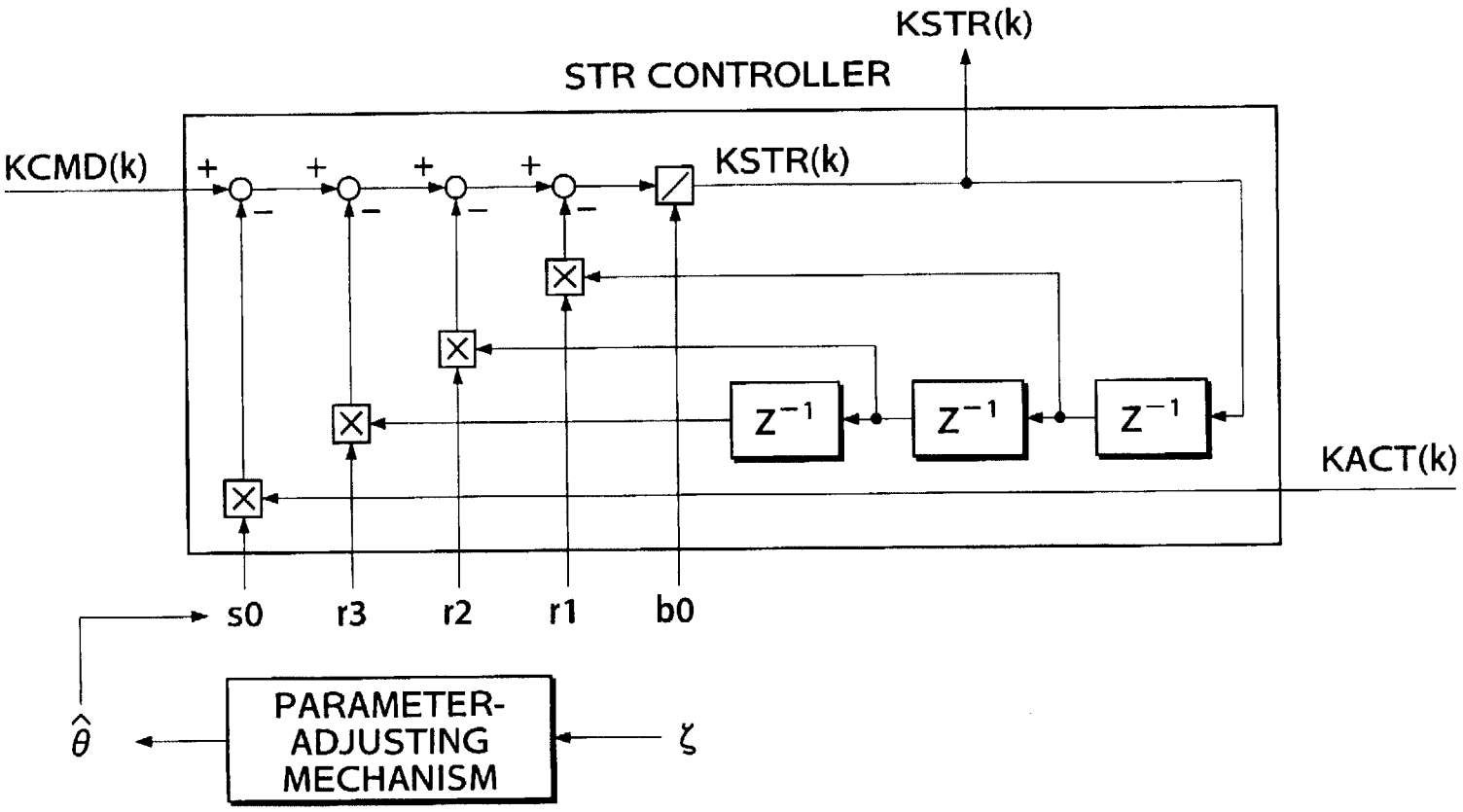
FIG. 20 is a block diagram useful in explaining a manner of calculating an adaptive control correction coefficient KSTR.

FIG. 20 shows the construction of the block B19 in FIG. 2, i.e. the self-tuning regulator (hereinafter referred to as "the STR") block. The STR block is comprised of a STR controller for setting the adaptive control correction coefficient KSTR such that the detected equivalent ratio KACT(k) becomes equal to the desired air-fuel ratio coefficient (desired equivalent ratio) KCMD(k), and a parameter adjusting mechanism for setting parameters to be used by the STR controller.

Adjustment laws (mechanisms) for adaptive control employed in the present embodiment include a parameter adjustment law proposed by Landau et al. According to this parameter adjustment law, the stability of the so-called adaptive system is ensured by converting the so-called adaptive system to an equivalent feedback system formed of a linear block and a non-linear block, and setting the parameter adjustment law such that Popov's integral inequality holds in respect of inputting to and outputting from the non-linear block and at the same time the linear block is "strictly positive real". This law is known and described e.g. in "Computrole" No. 27, CORONA PUBLISHING CO., LTD., Japan, pp. 28–41, "Automatic Control Handbook" OHM, LTD., Japan, pp. 703–707, "A Survey of Model Reference Adaptive Techniques-Theory and Application", I. D. LANDAU "Automatica" Vol. 10, pp. 353–379, 1974, "Unification of Discrete Time Explicit Model Reference Adaptive Control Designs", I. D. LANDAU et al. "Automatica" Vol. 17, No. 4, pp. 593–611, 1981, and "Combining Model Reference Adaptive Controllers and Stochastic Self-tuning Regulators", I. D. LANDAU "Automatica" Vol. 18, No. 1, pp. 77–84, 1992.

In the present embodiment, the above parameter adjustment law proposed by Landau et al. is employed. This parameter adjustment law will be described in detail hereinbelow: According to this adjustment law, if polynomials of the denominator and numerator of the transfer function A(Z−1)/B(Z−1) of the object of control by a discrete system are expressed by the following equations (12) and (13), the adaptive parameter $\hat{\theta}^T(k)$ and the input $\zeta(k)$ to the adaptive parameter adjusting mechanism are defined by the following equations (14) and (15). The equations (12) to (15) define an example of a plant in which m=1, n=1, and d=3 hold, i.e. a system of the first order thereof has an ineffective time as long as three control cycles. The symbol k used herein indicates that the parameter with (k) has the present value, one with (k−1) the immediately preceding value, and so forth. u(k) and y(k) correspond to the KSTR(k) and KACT (k) values, respectively, in the present embodiment.

$$A(z^{-1}) = 1 + a_1 z^{-1} + \ldots + a_n z^{-n} \tag{12}$$

$$B(z^{-1}) = b_0 + b_1 z^{-1} + \ldots + b_m z^{-m} \tag{13}$$

$$\begin{aligned}\hat{\theta}^T(k) &= [b_0(k), r_1(k), \ldots r_{m+d-1}(k), S_0(k), \ldots, S_{n-1}(k)] \\ &= [b_0(k), r_1(k), r_2(k), r_3(k), s_0(k)]\end{aligned} \tag{14}$$

$$\begin{aligned}\zeta^T(k) &= [u(k), \ldots, u(k-m-d+1), y(k), \ldots, y(k-n+1)] \\ &= [u(k), u(k-1), u(k-2), u(k-3), y(k)]\end{aligned} \tag{15}$$

The adaptive parameter $\hat{\theta}^T(k)$ is expressed by the following equation (16):

$$\hat{\theta}(k)=\hat{\theta}(k-1)+\Gamma(k-1)\zeta(k-d)e^*(k) \tag{16}$$

where the symbols Γ(k) and e*(k) represent a gain matrix and an identification error signal, respectively, and can be expressed by the following recurrence formulas (17) and (18):

$$\Gamma(k) = 1/\lambda 1(k) \times [\Gamma(k-1) - \{\lambda 2(k)\Gamma(k-1)\zeta(k-d)\zeta^T(k-d)\Gamma(k-1)\}/\{\lambda 1(k) + \lambda 2(k)\zeta^T(k-d)\Gamma(k-1)\zeta(k-d)\}] \tag{17}$$

$$e^*(k) = [D(z^{-1})y(k) - \hat{\theta}^T(k-1)\zeta(k-d)]/[1 + \zeta^T(k-d)\Gamma(k-1)\zeta(k-d)] \tag{18}$$

It should be noted that in the equation (18), $D(z^{-1})$ represents an asymptotically stable polynominal which a designer can give as desired, and is set to "1" in this example.

Further, it is possible to provide various specific algorithms depending upon set values of λ1(k) and λ2(k) of the equation (17). For example, if λ1(k)=1 and λ2(k)=λ (0<λ1<2), a progressively decreasing gain algorithm is provided (if λ=1, the least square method), if λ1(k)=λ1 (0<λ1<1) and λ2(k)=λ2 (0<λ2<2), a variable gain algorithm (if λ2=1, the method of weighted least squares), and if λ1(k)/λ2(k)=σ and if λ3 is expressed by the following equation (19), λ1(k)=λ3 provides a fixed trace algorithm. Further, if λ1(k)=1 and λ2(k)=0, a fixed gain algorithm is obtained. In this case, as is clear from the equation (17), Γ(k)=Γ(k−1), and hence Γ(k)=Γ (fixed value) is obtained.

$$\lambda 3(k) = 1 - [\|\Gamma(K-1)\zeta(k-d)\|^2/\{\sigma + \zeta^T(k-d)\Gamma(k-1)\zeta(k-d)\}] \cdot [1/tr\Gamma(0)] \tag{19}$$

It should be noted that in the equation (19), trΓ(0) represents the trace of an initial value of Γ.

In the example of FIG. 20, the STR controller (adaptive controller) and the adaptive parameter adjusting mechanism are arranged outside the fuel injection amount-calculating system, and operate to calculate the feedback correction coefficient KSTR(k) such that the actual air-fuel ratio KACT (k) becomes equal to the desired air-fuel ratio coefficient KCMD (k–d') (d' represents the above-mentioned ineffective time period before the KCMD value reflects on the actual air-fuel ratio KACT) in an adaptive manner.

In this manner, the adaptive control correction coefficient KSTR(k) and the actual equivalent ratio KACT(k) are determined, which are input to the adaptive parameter-adjusting mechanism, where the adaptive $\hat{\theta}^T(k)$ is calculated to be input to the STR controller. The STR controller is also supplied with the desired equivalent ratio coefficient KCMD (k) and calculates the adaptive control correction coefficient KSTR(k) such that the actual equivalent ratio KACT(k) becomes equal to the desired equivalent ratio coefficient KCMD(k), by the use of the following recurrence formula (20):

$$KSTR(k) = [KCMD(k-d') - s_0 \times KACT(k) - r_1 \times KSTR(k-1) - r_2 \times KSTR(k-2) - r_3 \times KSTR(k-3)]/b_0 \tag{20}$$

Next, a manner of calculation of the feedback correction coefficient KFB by switching between the PID correction coefficient KLAF and the adaptive control correction coefficient KSTR, i.e. by switching between the PID control and the adaptive control, will be described.

Figure 21:
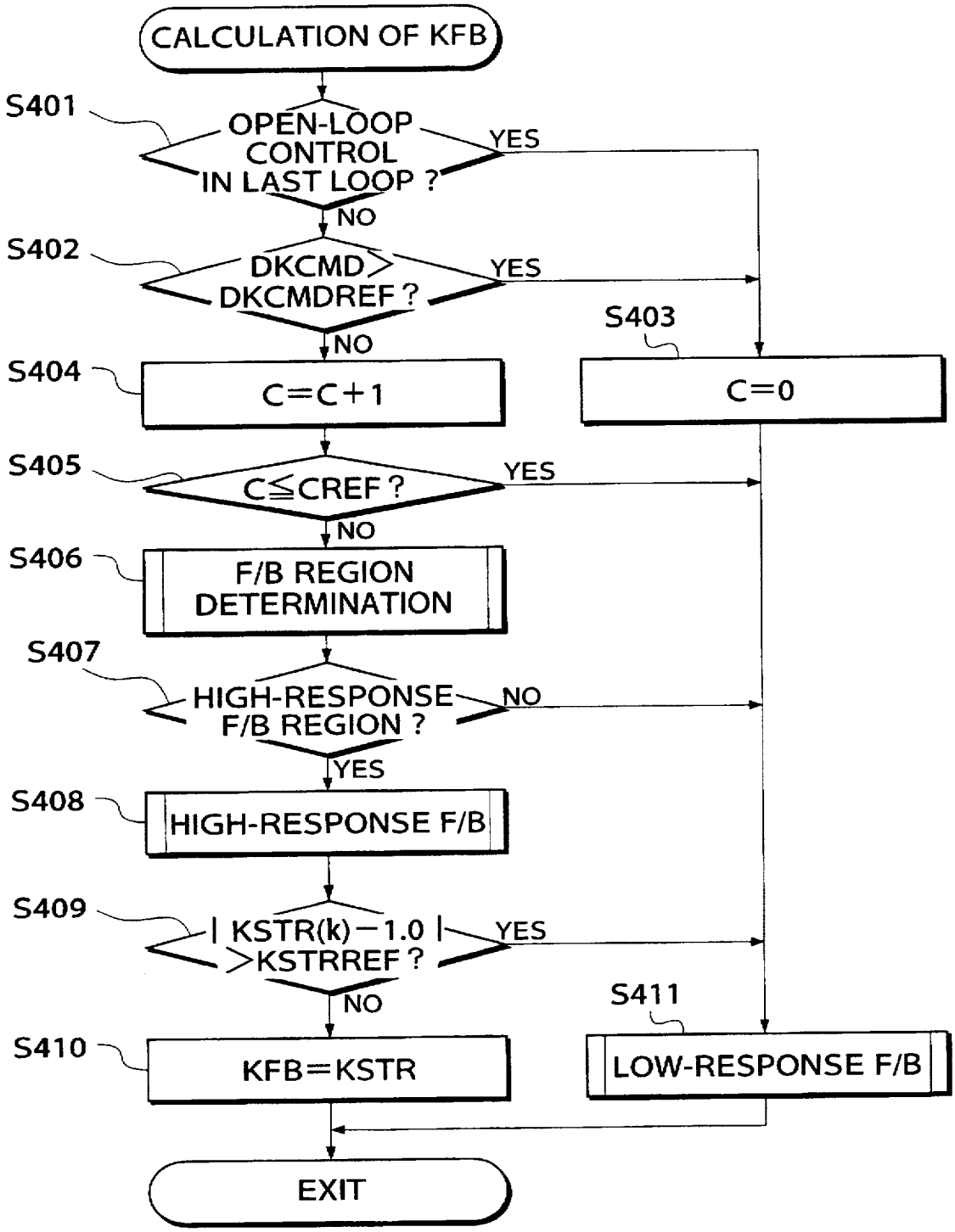
FIG. 21 is a flowchart showing a subroutine for calculating a feedback correction coefficient KFB, which is executed at a step S9 in FIG. 3.

FIG. 21 shows a subroutine for calculating the feedback correction coefficient KFB, which is executed at the step S9 in FIG. 3.

First, it is determined at a step S401 whether or not the control mode was an open-loop control mode in the last loop of execution of the FIG. 3 routine, i.e. whether or not FKLAFRESET=1 held. If the control mode was not the open-loop control mode, it is determined at a step S402 whether or not a rate of variation DKCMD in the desired equivalent ratio KCMD (=|KCMD(k)−KCMD(k−1)|) is larger than a reference value DKCMDREF. If the control mode was the open-loop control mode in the last loop of execution of the FIG. 3 routine, or if the control mode was the feedback control mode in the last loop of execution of the FIG. 3 routine and at the same time the rate of variation DKCMD is larger than the reference value DKCMDREF, it is judged that the engine is in a region where the low-response feedback control should be executed (hereinafter referred to as "the low-response F/B region"). Then, a counter C is reset to "0" at a step S403, followed by the program proceeding to a step S411. At the step S411, the low-response F/B control is executed, which will be described with reference to FIG. 25, followed by terminating the program.

The engine is determined to be in the low-response F/B region when the engine was in the open-loop region in the last loop because an air-fuel ratio value indicated by the LAF sensor output does not necessarily show a true or exact value of the air-fuel ratio of the mixture supplied to the engine due to delay of detection of the LAF sensor, which will occur e.g. when the fuel supply is resumed after fuel cut, so that the air-fuel ratio feedback control can be unstable. For a similar reason, when the amount of change DKCMD in the desired equivalent ratio KCMD is large, which will occur e.g. when a WOT enriching operation is stopped to resume the normal air-fuel control, or when the air-fuel ratio control is switched over from the lean-burn control to the feedback control to the stoichiometric air-fuel ratio, the engine is determined to be in the low-response F/B region.

If the answers to the questions of the steps S401 and S402 are both negative (NO), i.e. if the control mode was the feedback control mode in the last loop and at the same time the rate of variation DKCMD in the desired equivalent ratio KCMD is smaller than the reference value DKCMDREF, the count of the counter C is incremented by "1" at a step S404, and then the count of the counter C is compared with a predetermined value CREF (e.g. 5) at a step S405. If C≦CREF holds, the program proceeds to the step S411, whereas if C>CREF holds, the program proceeds to a step S406, wherein it is determined by executing a subroutine, described hereinafter, whether the engine is operating in a region in which a high-response feedback control should be executed (hereinafter referred to as "high-response F/B region") or in the low-response F/B region. Then, at a step S407, it is determined whether or not the control region in which the engine has been determined to be operating at the step S406 is the high-response F/B region. If the determined control region is not the high-response F/B region, the program proceeds to the step S411, whereas if the control region is the high-response F/B region, the program proceeds to a step S408, wherein a subroutine for the high-response feedback control, described hereinafter, is executed to calculate the adaptive control correction coefficient KSTR. Then, it is determined at a step S409 whether or not the absolute value of the difference |KSTR(k)−1.0| between the adaptive control correction coefficient KSTR and 1.0 is larger than a predetermined reference value KSTRREF. If |KSTR(k)−1.0|>KSTRREF holds, the program proceeds to the step S411, whereas if |KSTR(k)−1.0|≦KSTRREF holds, the feedback correction coefficient KFB is set to the KSTR value at a step S410, followed by terminating the program.

When the absolute value of the difference between the adaptive control correction coefficient KSTR and 1.0 is larger than the predetermined reference value KSTRREF, the low-response feedback control is selected for the purpose of achieving stability of the control.

When the count of the counter C is smaller than the reference value CREF, the low-response feedback control is selected because immediately after returning of the engine operating condition from the open-loop control or immediately after a large variation in the desired equivalent ratio KCMD, a time lag before completion of fuel combustion and a response lag of the LAF sensor are so large that influences thereof cannot be compensated for by the adaptive control.

Figure 22:
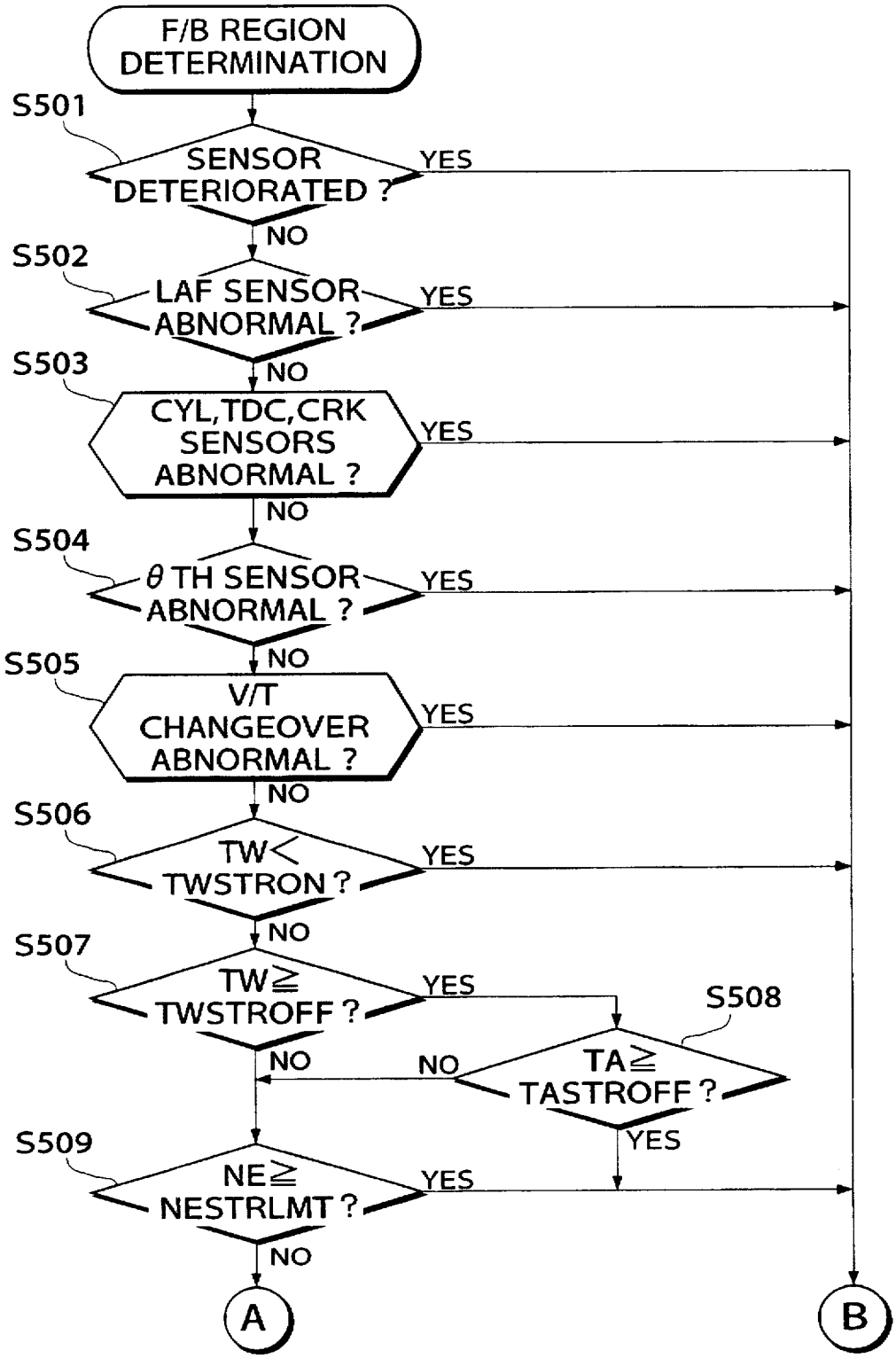
FIG. 22 is a flowchart showing a subroutine executed at a step S406 in FIG. 21 for selecting the response speed of the air-fuel ratio feedback control, i.e. for determining whether the engine is operating in a region where a high-response feedback control should be executed or in a region where a low-response feedback control should be executed.
Figure 23:
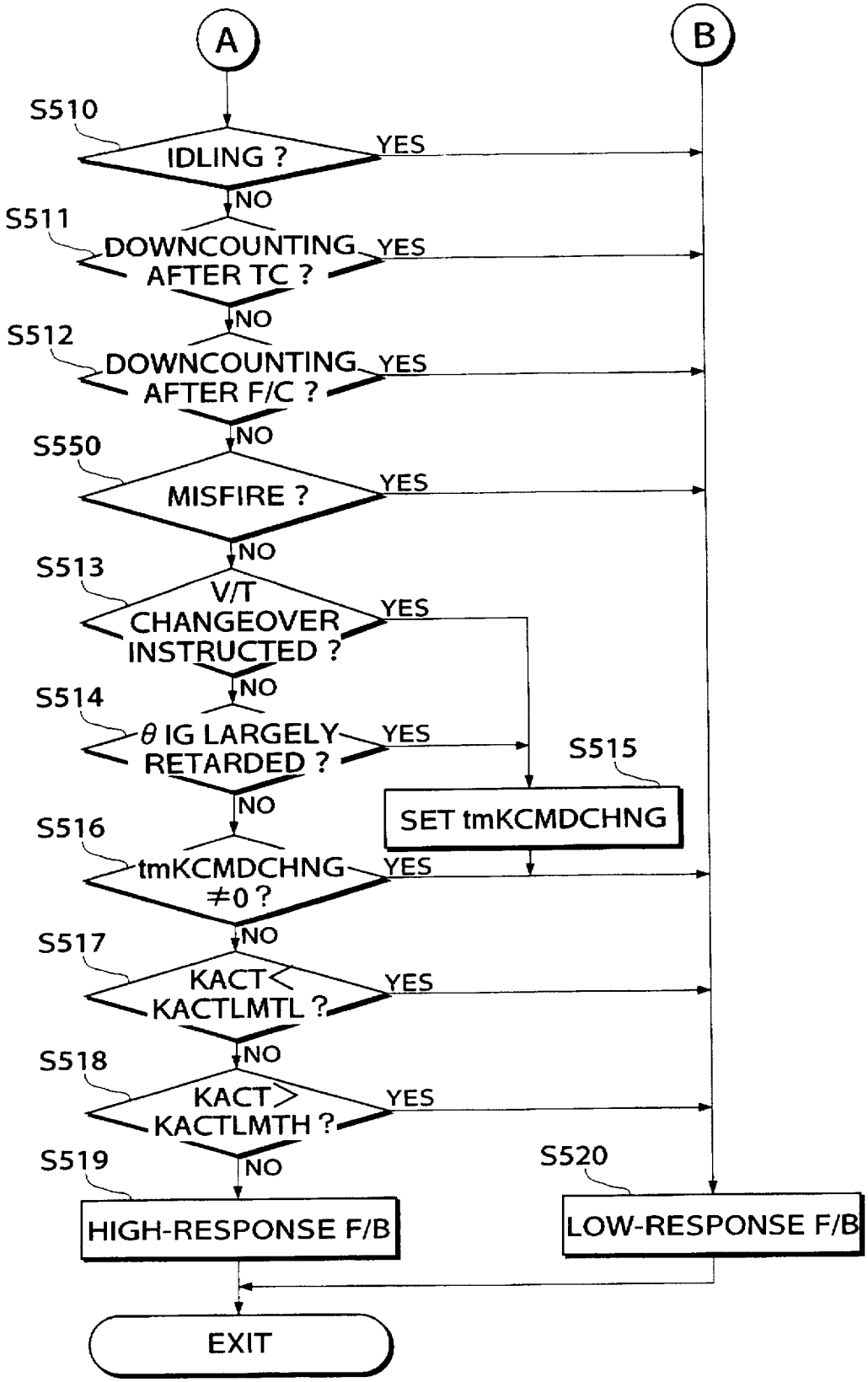
FIG. 23 is a continued part of the FIG. 22 flowchart.

Next, the subroutine executed at the step S406 in FIG. 21 for selecting the response speed of the air-fuel ratio feedback control, i.e. determining whether the engine is operating in the high-response F/B region or in the low-response F/B region will be described with reference to FIG. 22.

First, at a step S501, it is determined whether or not the LAF sensor 17 has been deteriorated in response characteristic. If the LAF sensor 17 has not been deteriorated in response characteristic, the program proceeds to a step S502.

At the step S502, it is determined whether or not abnormality of the LAF sensor 17 has been detected. If no abnormality of the LAF sensor 17 has been detected, it is determined at a step S503 whether or not abnormality of the crank angle sensor 14 (cylinder-discriminating sensor, TDC sensor, CRK sensor) has been detected. If no abnormality of the crank angle sensor has been detected, it is determined at a step S504 whether or not abnormality of the throttle valve opening θTH sensor 4 has been detected. If no abnormality of the throttle valve opening sensor 4 has been detected, it is determined at a step S505 whether or not abnormality of the valve timing changeover mechanism 60 has been detected.

If all the answers to the questions of the steps S501 to S505 are negative (NO), the program proceeds to a step S506, whereas if any of the answers is affirmative (YES), it is determined at a step S520 that the engine is in the low-response F/B region, followed by terminating the program.

The low-response feedback control is thus selected when any of the above-mentioned sensors is abnormal, so as to prevent lowering of the controllability of the air-fuel ratio.

Then, at the step S506, it is determined whether or not the engine coolant temperature TW is lower than a predetermined value TWSTRON. If TW≧TWSTRON holds, it is determined at a step S507 whether or not the engine coolant temperature TW is equal to or higher than a predetermined value TWSTROFF (e.g. 100° C.). If TW≧TWSTROFF holds, it is determined at a step S508 whether or not the intake air temperature TA is equal to or higher than a predetermined value TASTROFF. If TW<TWSTROFF holds at the step S507 or if TW≧TWSTROFF holds at the step S507 and at the same time TA<TASTROFF holds at the step S508, the program proceeds to a step S509, wherein it is determined whether or not the engine rotational speed NE is equal to or higher than a predetermined value NESTRLMT. If NE<NESTRLMT holds, it is determined at a step S510 whether or not the engine is idling. If the engine is not idling, it is determined at a step S511 whether or not a timer is in operation for measuring a time period elapsed after termination of traction control by the traction control system (TCS). This timer is formed by a downcount timer, and set during TCS operation and starts when the TCS operation is terminated.

If the timer is not in operation at the step S511, it is determined at a step S512 whether or not a timer is in operation for measuring a time period elapsed after termination of fuel cut. The fuel cut is carried out when the engine is in a predetermined decelerating condition, and the fuel cut flag FFC is set to "1" during the fuel cut operation. This timer is also formed by a downcount timer, and set during the fuel cut operation and starts downcounting operation after termination of fuel cut.

If any of the answers to the questions of the steps S506 and S509 to S512 is affirmative (YES), or if both the answers to the questions of the steps S507 and S508 are affirmative (YES), it is determined at the step S520 that the engine is in the low-response F/B region, followed by terminating the program. If the answer to the question of the step S512 is negative (NO), the program proceeds to a step S550.

At the step S550, it is determined whether or not a misfire has ocurred in the engine. A misfire can be determined to have occurred in the engine when the variation of the engine rotational speed NE is above a predetermined value, as disclosed in Japanese Laid-Open Patent Publication (Kokai) No. 6-146998 filed by the present assignee. When the engine suffers from a misfire, the program proceeds to the step S520, whereas when the engine does not suffer from a misfire, the program proceeds to a step S513.

At the step S513, it is determined whether or not changeover of the valve timing between the high-speed V/T and the low-speed V/T has been instructed. If the changeover has not been instructed, it is determined at a step S514 whether or not the ignition timing of the engine has been largely retarded. If the ignition timing has not been retarded, the program proceeds to a step S516. If either the answer to the question of the step S513 or the answer to the question of the step S514 is affirmative (YES), a tmKCMDCHNG downcount timer is set to a predetermined time period TCHNG and started at a step S515, followed by the program proceeding to the step S520. The predetermined time period TCHNG is set to a time period sufficient for the combustion of the engine to become stable after the changeover of the valve timing has been instructed or after the ignition timing has been largely retarded.

At the step S516, it is determined whether or not the count of the tmKCMDCHNG downcount timer is not equal to "0". If the count is not equal to "0", the program proceeds to the step S520, whereas if the count is equal to "0", it is determined at steps S517 and S518 whether or not the actual equivalent ratio KACT is within a predetermined range defined by a predetermined lower limit value KACTLMTL (e.g. 0.99) and a predetermined upper limit value KACTLMTH (e.g. 1.01). If KACT<KACTLMTL or KACT>KACTLMTH holds, the program proceeds to the step S520, whereas if KACTLMTL≦KACT≦KACTLMTH holds, the program proceeds to a step S519, wherein it is determined that the engine is in the high-response F/B region, followed by terminating the program.

By executing the steps S517 and S518, changeover of the feedback control from the low-response feedback control to the high-response feedback control is carried out only when the actual equivalent ratio KACT is equal to 1.0 or a value close thereto, to thereby achieve smooth changeover of the feedback control mode and hence ensure required stability of the fuel-ratio control.

The reason why it is thus determined by the steps S506 to S516 that the low-response feedback control should be executed is as follows: When the engine coolant temperature TW is low (TW<TWSTRON), the engine combustion is not stable due to insufficient atomization of fuel and increased friction between the piston and the cylinder, so that a misfire can occur. Therefore, a stable value of the detected equivalent ratio KACT cannot be obtained if the high-response feedback control is carried out in such a condition. Also when the engine coolant temperature TW is extremely high (TW≧TWSTROFF) and at the same time the intake air temperature is extremely high (TA≧TASTROFF), vapor lock can occur in the fuel supply line to decrease the actual amount of fuel injection. When the engine rotational speed NE is high, i.e. if NE≧NESTRLMT holds, the ECU 5 can have an insufficient calculation time and further the engine combustion is not stable. Further, when the engine is idling, the engine operating condition is almost stable such that the adaptive control, which has a high gain, is not required to be carried out. Immediately after termination of the traction control in which the ignition timing is temporarily largely retarded or fuel cut is effected to decrease the torque of the engine so as to avoid excessive slippage of the wheels, the engine combustion is not stable before a predetermined time period elapses after termination of the traction control, so that execution of the high-response feedback control can unexpectedly result in an increase in the variation of the air-fuel ratio. For a similar reason, immediately after termination of a usual decelerating fuel cut operation, the low-response feedback control is selected. Similarly, when a misfire occurs in the engine, the engine combustion is undoubtedly unstable, so that the low-response feedback control is selected. Further, before a predetermined time period (TCHNG) elapses after changeover of the valve timing, the combustion state of the engine drastically changes due to a change in the valve opening period over which the intake or exhaust valves are opened. Also, before the predetermined time period TCHNG elapses after termination of control of ignition timing to a largely retarded timing, the engine combustion is not stable, and hence a stable KACT value cannot be expected.

In addition to the traction control, large retardation of the ignition timing may be carried out in execution of other kinds of control such as torque shock-reducing control executed when the automatic transmission undergoes a change in the shift gear position, knocking-avoiding control executed when load on the engine is high, ignition timing control executed for the purpose of accelerating the rise of the temperature of the catalysts immediately after the engine is started, or on like occasions.

Next, the high-response/low-response feedback control executed by the control system according to the present embodiment will be described.

Figure 24:
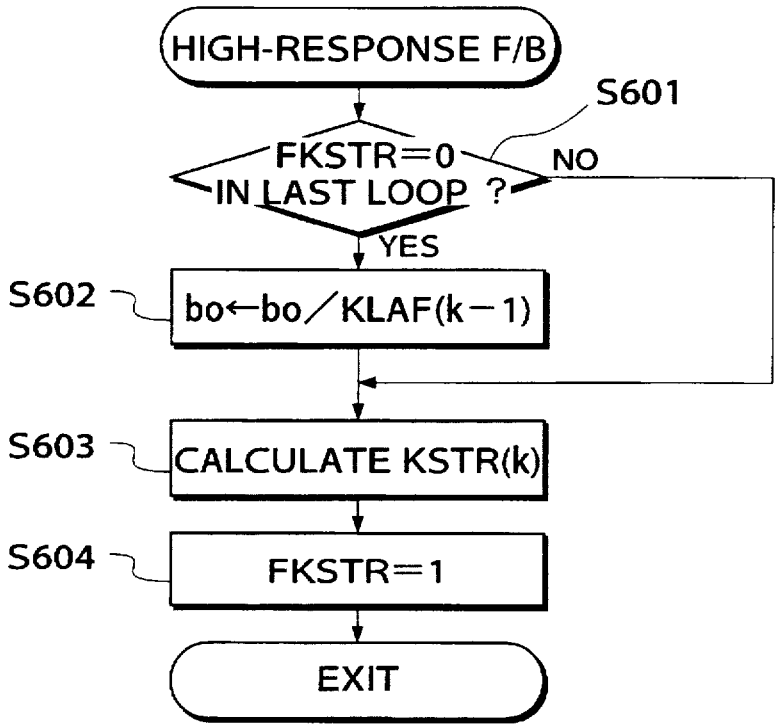
FIG. 24 is a flowchart showing a subroutine for the high-response feedback control, which is executed by the air-fuel ratio control system according to the first embodiment at a step S408 in FIG. 21.

FIG. 24 shows a subroutine for carrying out the high-response feedback control executed at the step S408 in FIG. 21. First, at a step S601, it is determined whether or not the flag FKSTR, which, when set to "1", indicates that the engine is operating in a region in which the feedback control by the use of the adaptive control correction coefficient KST should be executed (hereinafter referred to as "the adaptive control region"), assumed "0" in the immediately preceding loop. If the flag KSTR assumed "1" in the last loop, the program jumps to a step S603, wherein the adaptive control correction coefficient KSTR is calculated in the manner described hereinbefore, and then the flag FKSTR is set to "1" at a step S604, followed by terminating the program.

On the other hand, if the flag FKSTR assumed "0" in the last loop, the adaptive parameter b0 (scalar quantity determining the gain) is replaced by a value obtained by dividing the b0 value by the last value KLAF(k−1) of the PID correction coefficient KLAF at a step S602, followed by the program proceeding to the step S603.

By replacing the adaptive parameter b0 by the value b0/KLAF(k−1) at the step S602, further smooth changeover from the PID control to the adaptive control can be obtained to thereby ensure required stability of the control. The reason for carrying out the replacement is as follows: If the value b0 in the equation (20) is replaced by the value b0/KLAF(k−1), the following equation (21) is obtained, where the first term of the first equation is equal to "1" because the adaptive control correction coefficient KSTR is set to and held at 1 (KSTR(k)=1) during execution of the PID control. Accordingly, the value KSTR(k) at the start of the adaptive control becomes equal to the value KLAF(k−1), resulting in smooth changeover of the correction coefficients:

$$\begin{aligned} KSTR(k) &= [\{KCMD(k-d') - s_0 \times KACT(k) - \\ &\quad r_1 \times KSTR(k-1) - r_2 \times KSTR(k-2) - \\ &\quad r_3 \times KSTR(k-3)\}/b_0] \times KLAF(k-1) \\ &= 1 \times KLAF(k-1) \\ &= KLAF(k-1) \end{aligned} \tag{21}$$

Figure 25:
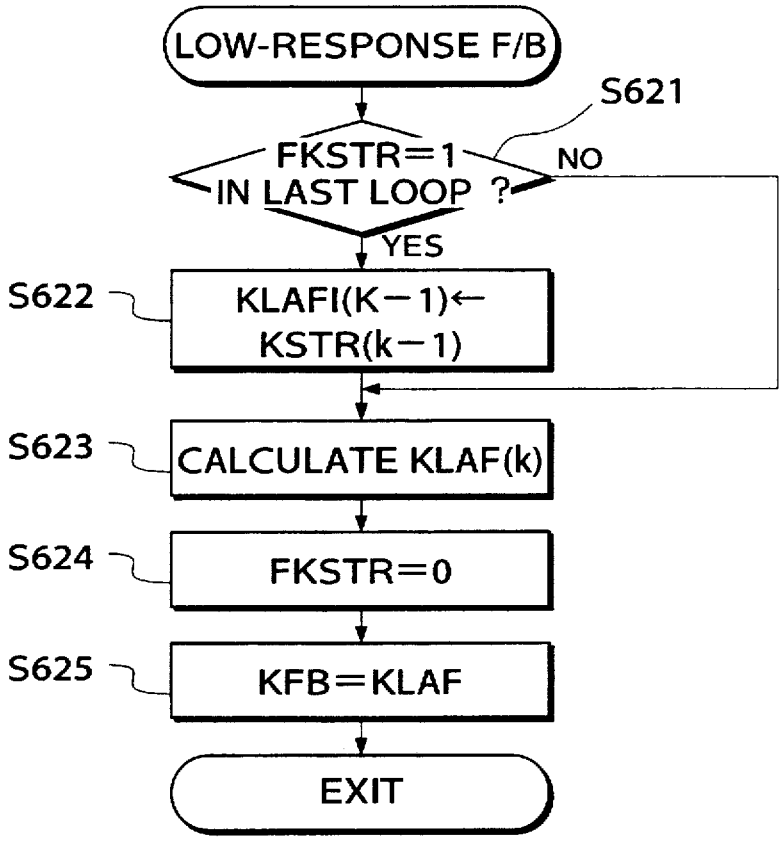
FIG. 25 is a flowchart showing a subroutine for the low-response feedback control, which is executed by the air-fuel ratio control system according to the first embodiment at a step S411 in FIG. 21.

FIG. 25 shows a subroutine for carrying out the low-response feedback control executed at the step S411 of the FIG. 21 subroutine. First, at a step S621, it is determined whether or not the STR flag FKSTR assumed "1" in the last loop. If FKSTR=0 held in the last loop, the program jumps to a step S623, wherein the PID correction coefficient KLAF is calculated by executing the FIG. 19 subroutine. Then, the flag FKSTR is set to "0" at a step S624, and the program proceeds to a step S625, wherein the feedback correction coefficient KFB is set to the PID correction coefficient KLAF(k) calculated at the step S623, followed by terminating the present program.

On the other hand, if FKSTR=1 held in the last loop, the immediately preceding value KLAFI(k−1) of the integral term of the PID control is set to the immediately preceding value KSTR(k−1) of the adaptive control correction coefficient KSTR at a step S622, followed by the program proceeding to the step S623.

When changeover from the adaptive control to the PID control is carried out (if FKSTR=1 held in the immediately preceding loop and the engine is in the low-response F/B region in the present loop), there is a possibility of a drastic change in the integral term KLAFI of the PID control. Therefore, the step S622 is executed to set KLAF(k−1)= KSTR(k−1). This can reduce the difference between the adaptive control correction coefficient KSTR(k−1) and the PID correction coefficient KLAF(k), whereby smooth changeover from the adaptive control to the PID control can be carried out, to thereby ensure required stability of the engine control.

By virtue of the operations carried out by the FIGS. 21 to 25 subroutines, so long as the engine combustion is not in a steady condition, the air-fuel ratio feedback control is changed over from the adaptive control to the PID control, whereby sufficient accuracy and stability of the air-fuel ratio control can be ensured even when the engine is not in a steady operating condition, to thereby maintain excellent driveability and exhaust emission characteristics of the engine.

Next, a control system according to a second embodiment of the invention will be described. This embodiment is distinguished from the first embodiment described above in that while in the first embodiment whether or not the engine is operating in the low-response F/B region or the high-response F/B region is determined depending on operating conditions of the engine, then the adaptive control is applied as the high-response feedback control, and the PID control as the low-response feedback control, in the second embodiment the adaptive control is also applied as the low-response feedback control but the response speed is reduced, instead of executing the PID control. Therefore, description of the second embodiment is identical with that of the first embodiment except for those described hereinabove with reference to FIGS. 24 and 25, which are replaced by FIGS. 26 and 27 in the present embodiment. Further, it should be noted that in the illustrated embodiments, the algorithm of the adaptive control is set to a fixed gain algorithm, i.e. gain matrix Γ(k)=Γ.

Figure 26:
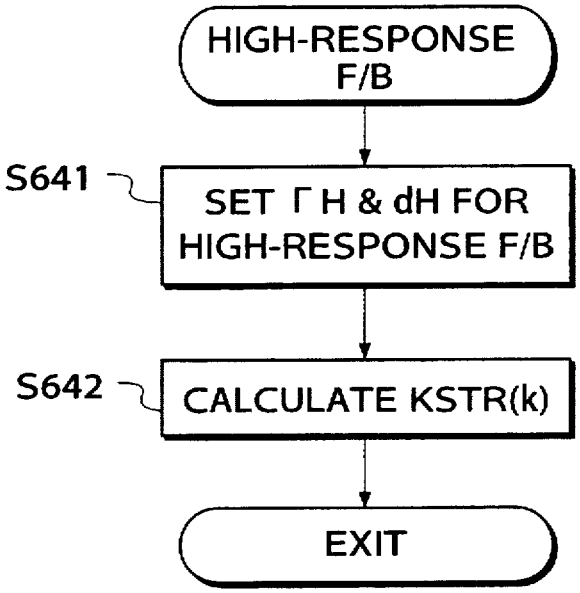
FIG. 26 is a flowchart showing a subroutine for the high-response feedback control, which is executed by the air-fuel ratio control system according to a second embodiment at the step S408 in FIG. 21.

FIG. 26 shows a subroutine for carrying out the high-response feedback control, which is executed at the step S408 in FIG. 21. First, at a step S641, a gain matrix ΓH for the high-response feedback control is selected as the gain matrix Γ, and at the same time the number of cycles d indicative of the ineffective time of the adaptive control is set to a value dH for the high-response feedback control. Then, the adaptive control correction coefficient KSTR is calculated at a step S642 in the manner described hereinbefore, followed by terminating the program.

Figure 27:
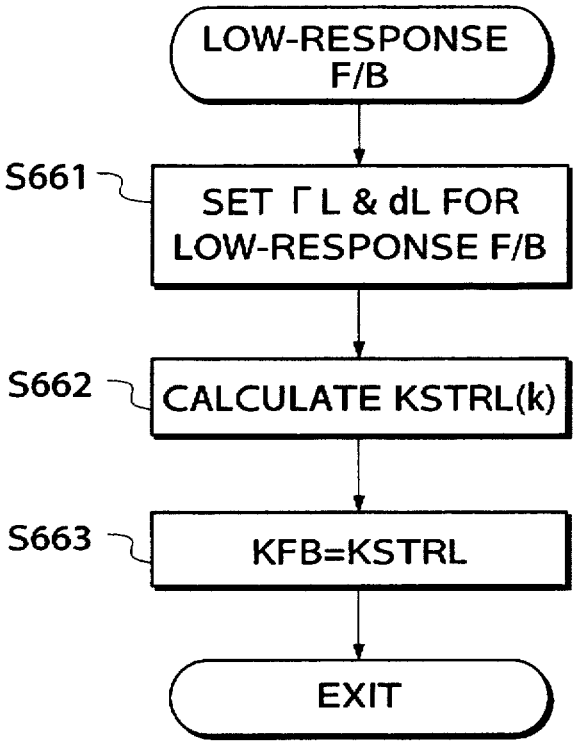
FIG. 27 is a flowchart showing a subroutine for the low-response feedback control, which is executed by the air-fuel ratio control system according to the second embodiment of the invention at the step S411 in FIG. 21.

FIG. 27 shows a subroutine for carrying out the low-response feedback control, which is executed at the step S411 of the FIG. 21 routine.

At a step S661, a gain matrix ΓL for the low-response feedback control is selected as the gain matrix Γ, and at the same time the number of cycles d indicative of the ineffective time of the adaptive control is set to a value dL for the low-response feedback control, which is larger than the value dH. Then, an adaptive control correction coefficient KSTRL for the low-response feedback control is calculated at a step S662, and the feedback correction coefficient KFB is set to the KSTRL value at a step S663, followed by terminating the program.

The gain matrix ΓL for the low-response feedback control is set such that it provides a smaller gain than the gain matrix ΓH for the high-response feedback control. More specifically, the gain matrix is defined by the following equation (22):

$$\Gamma = \begin{bmatrix} g_1 & 0 & 0 & 0 & 0 \\ 0 & g2 & 0 & 0 & 0 \\ 0 & 0 & g3 & 0 & 0 \\ 0 & 0 & 0 & g4 & 0 \\ 0 & 0 & 0 & 0 & g5 \end{bmatrix} \tag{22}$$

The equation (22), which represents the gain matrix Γ used in the present embodiment, is formed by a row of five parameters and a column of five parameters.

The magnitudes of adaptive parameters g1, g2, g3, g4 and g5 determine rates of change in the adaptive parameters b0, r1, r2, r3 and s0 calculated by the parameter-adjusting mechanism. Therefore, by setting the parameters g1, g2, g3, g4 and g5 to smaller values than the gain matrix ΓH for the high-response feedback control, the gain matrix ΓL for the low-response feedback control is obtained, which sets a lower adjustment rate or speed of the adaptive parameters calculated by the parameter-adjusting mechanism. In the present case, all the parameters g1 to g5 are set to smaller values as mentioned above. Alternatively, only part of them may be changed. For example, the parameters g1 to g4 corresponding to rates of change of the adaptive parameters r1 to r3, which define the gain of the control system, may be changed, or one or both of the parameters g1 and g5 corresponding to rates of change of the adaptive parameters s0 and b0, which define the responsiveness of the control system, may be changed.

Further, the responsiveness of the control system is determined by the whole gain matrix Γ, and therefore it is possible to lower the responsiveness of the control system by changing the parameters independently of each other, e.g. by decreasing the parameter g5 and slightly increasing the parameters g2 to g4.

By executing the subroutines shown in FIGS. 21 to 23, and FIGS. 26 and 27, according to the second embodiment, it is possible to obtain the same effect as obtained by the first embodiment, i.e. the effect of suppressing undesired variations in the air-fuel ratio when the engine combustion is not in a steady condition.

Although in the present embodiment, the parameters g1, g2, g3, g4 and g5 of the gain matrix are set to predetermined values for the high-response feedback control and predetermined values for the low-response feedback control in advance, this is not limitative, but the parameters g1 to g5 can be set during operation of the engine according to a degree of degradation of the engine combustion which is detected while the engine is in operation.

Further, although in the present embodiment, the parameters of the gain matrix Γ and the number of cycles d indicative of the ineffective time are both changed to change the speed of the adaptive control depending upon whether or not the engine is operating in the low-response F/B region or the high-response F/B region, this is not limitative, but only one of the gain matrix and the number of cycles d may be changed instead.

Still further, although when the engine is in an unstable or unsteady condition, the air-fuel ratio feedback control is changed over from the adaptive control to the PID control in the first embodiment, and the response speed of the adaptive control is changed in the second embodiment, this is not limitative, but both of the measures for the air-fuel ratio feedback control in an unstable or unsteady condition of the engine may be employed for selective use depending on the situation or operating conditions of the engine.

What is claimed is:

1. In an air-fuel ratio control system for an internal combustion engine having an exhaust passage, and catalyst means arranged in said exhaust passage, for purifying exhaust gases emitted from said engine, said air-fuel ratio control system including a first air-fuel ratio sensor arranged in said exhaust passage at a location upstream of said catalyst means, and a second air-fuel ratio sensor arranged in said exhaust passage at a location downstream of said catalyst means, first feedback control means responsive to an output from said first air-fuel ratio sensor, for calculating an air-fuel ratio correction coefficient for correcting an amount of fuel supplied to said engine in a manner such that an air-fuel ratio of a mixture supplied to said engine is converged to a desired air-fuel ratio, second feedback control means responsive to an output from said second air-fuel ratio sensor, for calculating a desired air-fuel ratio correction amount for correcting said desired air-fuel ratio, and learning/correcting means for calculating a learned value of said desired air-fuel ratio correction amount, and for correcting said desired air-fuel ratio, the improvement wherein said learning/correcting means comprises learned value calculation-permitting means for permitting calculation of said learned value of said desired air-fuel ratio correction amount depending on a ratio between a time period over which said output from said second air-fuel ratio sensor is on a richer side with respect to a predetermined reference value and a time period over which said output from said second air-fuel ratio sensor is on a leaner side with respect to said predetermined reference value.

2. An air-fuel ratio control system according to claim 1, wherein said first air-fuel ratio sensor has an output characteristic that said output from said first air-fuel ratio sensor is substantially proportional to said air-fuel ratio of said mixture supplied to said engine.

3. An air-fuel ratio control system according to claim 1, wherein said first feedback control means comprises a controller of a recurrence formula type.

4. An air-fuel ratio control system according to claim 1, wherein said learning/correcting means includes learned correction amount-calculating means for calculating, based on said learned value of said desired air-fuel ratio correction amount, a learned correction amount for correcting said desired air-fuel ratio.

5. An air-fuel ratio control system according to claim 4, wherein said learning/correcting means corrects said desired air-fuel ratio by the use of both said desired air-fuel ratio correction amount and said learned correction amount.

6. An air-fuel ratio control system according to claim 4, wherein said learned correction amount-calculating means updates said learned correction amount whenever a predetermined time period elapses.

7. An air-fuel ratio control system according to claim 6, wherein said learning/correction means changes a control constant applied in calculating said desired air-fuel ratio correction amount, when said learned correction amount-calculating means has updated said learned correction amount.

8. An air-fuel ratio control system according to claim 6, wherein said learning/correcting means corrects said desired air-fuel ratio by the use of both said desired air-fuel ratio correction amount and said learned correction amount.

9. An air-fuel ratio control system according to claim 8, wherein said learning/correction means changes a control constant applied in calculating said desired air-fuel ratio correction amount, when said learned correction amount-calculating means has updated said learned correction amount.

10. An air-fuel ratio control system according to claim 9, wherein said learning/correcting means resets both said desired air-fuel ratio correction amount and said learned value of said desired air-fuel ratio correction amount to zero, when said learned correction amount-calculating means has updated said learned correction amount.

11. An air-fuel ratio control system according to claim 4, wherein said learning/correcting means includes averaging coefficient-setting means for setting an averaging coefficient to be applied in calculating said learned value of said desired air-fuel ratio correction amount, for each of a plurality of operating regions of said engine, said learned correction amount-calculating means calculating said learned correction amount for said each of a plurality of operating regions of said engine.

12. An air-fuel ratio control system according to claim 11, wherein said learned correction amount-calculating means updates said learned correction amount whenever a predetermined time period elapses.

13. An air-fuel ratio control system according to claim 12, wherein said learned correction amount-calculating means updates said learned correction amount without waiting for lapse of said predetermined time period, when said engine has changed from one of said plurality of operating regions to another of said plurality of operating regions.

14. An air-fuel ratio control system according to claim 13, wherein said learning/correction means changes a control constant applied in calculating said desired air-fuel ratio correction amount, when said learned correction amount-calculating means has updated said learned correction amount.

15. An air-fuel ratio control system according to claim 13, wherein said learning/correcting means corrects said desired air-fuel ratio by the use of both said desired air-fuel ratio correction amount and said learned correction amount.

16. An air-fuel ratio control system according to claim 15, wherein said learning/correction means changes a control constant applied in calculating said desired air-fuel ratio correction amount, when said learned correction amount-calculating means has updated said learned correction amount.

17. An air-fuel ratio control system according to claim 16, wherein said learning/correcting means resets both said desired air-fuel ratio correction amount and said learned value of said desired air-fuel ratio correction amount to zero, when said learned correction amount-calculating means has updated said learned correction amount.

* * * * *